US007074064B2

(12) United States Patent
Wallace

(10) Patent No.: US 7,074,064 B2
(45) Date of Patent: Jul. 11, 2006

(54) ELECTRICAL CONNECTOR USEFUL IN WET ENVIRONMENTS

(75) Inventor: Frank A. Wallace, Houston, TX (US)

(73) Assignee: PathFinder Energy Services, Inc., Houston, TX (US)

( * ) Notice: Subject to any disclaimer, the term of this patent is extended or adjusted under 35 U.S.C. 154(b) by 316 days.

(21) Appl. No.: 10/761,695

(22) Filed: Jan. 21, 2004

(65) Prior Publication Data

US 2005/0016769 A1 Jan. 27, 2005

Related U.S. Application Data

(60) Provisional application No. 60/489,565, filed on Jul. 22, 2003.

(51) Int. Cl.
*H01R 4/60* (2006.01)

(52) U.S. Cl. ..... 439/190; 166/65.1

(58) Field of Classification Search ..... 439/190, 439/94; 166/65.1

See application file for complete search history.

(56) References Cited

U.S. PATENT DOCUMENTS

| | | | |
|---|---|---|---|
| 3,641,479 | A | 2/1972 | O'Brien et al. |
| 3,829,814 | A | 8/1974 | Straus |
| 3,845,450 | A | 10/1974 | Cole et al. |
| 3,926,269 | A | 12/1975 | Cullen et al. |
| 4,016,943 | A | 4/1977 | Cullen et al. |
| 4,031,969 | A | 6/1977 | Cullen et al. |
| 4,039,237 | A | 8/1977 | Cullen et al. |
| 4,117,287 | A | 9/1978 | Walker et al. |
| 4,142,770 | A | 3/1979 | Butler, Jr. et al. |
| 4,174,875 | A | 11/1979 | Wilson et al. |
| 4,319,240 | A | 3/1982 | Stone et al. |
| 4,390,229 | A | 6/1983 | Chevalier |
| 4,500,156 | A | 2/1985 | Nguyen |
| 4,537,457 | A | 8/1985 | Davis, Jr. et al. |
| 4,553,807 | A | 11/1985 | Cane |
| 4,585,287 | A | 4/1986 | Ramsey et al. |
| 4,660,910 | A | 4/1987 | Sharp et al. |
| 4,767,349 | A | 8/1988 | Pottier et al. |
| 4,781,607 | A | 11/1988 | Rumbaugh |
| 4,909,751 | A | 3/1990 | Marolda, Jr. |
| 4,921,438 | A | 5/1990 | Godfrey et al. |
| 4,927,374 | A | 5/1990 | Batty |
| 5,131,464 | A | 7/1992 | Lenhart et al. |
| 5,141,051 | A | 8/1992 | Lenhart |
| 5,171,158 | A | 12/1992 | Cairns |
| 5,330,364 | A | 7/1994 | Mount, II et al. |
| 5,358,418 | A | 10/1994 | Carmichael |
| 5,389,003 | A | 2/1995 | Van Steenwyk et al. |
| 5,704,792 | A | 1/1998 | Sobhani |

(Continued)

*Primary Examiner*—James R. Harvey

(57) ABSTRACT

A multiple contact electrical connector for interconnecting multiple power and/or communication transmission lines is provided. The invention is particularly useful in wet environments. The electrical connector includes male and female connector assemblies. A male pin assembly having a plurality of annular contacts is configured to repeatedly engage and disengage with a female socket assembly having a corresponding plurality of ring contact assemblies. Various exemplary embodiments further include retractable members deployed for sealingly isolating the annular contacts and the ring contact assemblies from fluids exterior to the male and female connector assemblies.

53 Claims, 13 Drawing Sheets

U.S. PATENT DOCUMENTS

| | | | | |
|---|---|---|---|---|
| 5,746,606 | A | 5/1998 | Sobhani | |
| 5,820,416 | A | 10/1998 | Carmichael | |
| 5,967,816 | A | 10/1999 | Sampa et al. | |
| 6,315,461 | B1 | 11/2001 | Cairns | |
| 6,557,632 | B1 * | 5/2003 | Cernosek | 166/264 |
| 6,655,464 | B1 | 12/2003 | Chau et al. | |
| 6,672,382 | B1 * | 1/2004 | Schultz et al. | 166/65.1 |
| 2005/0016769 | A1 * | 1/2005 | Wallace | 175/40 |

* cited by examiner

TO FIG. 7B

ELECTRICAL CONNECTOR USEFUL IN WET ENVIRONMENTS

RELATED APPLICATIONS

This application claims the benefit of U.S. Provisional Application Ser. No. 60/489,565, entitled Electrical Connector Useful In Wet Environments, filed Jul. 22, 2003.

FIELD OF THE INVENTION

This invention relates generally to an electrical connector, and in particular to an electrical connector that provides electrical communication over of a plurality of transmission lines and is further functional in a wet environment, such as may be found in downhole or underwater environments.

BACKGROUND OF THE INVENTION

Tools employed for downhole measurement-while-drilling ("MWD") operations commonly include multiple specialty drill collar segments joined end to end, each segment housing one or more sensors that dynamically provide data about the tool and the surrounding formation. The batteries powering the sensors are typically housed in the individual drill collar segments along with the sensors. Such batteries commonly occupy several feet of tool space that undesirably, in some applications, places segments further away from the drill bit than may be optimal. For example, sensors assisting in decisions about steering the drill bit are often more effective when placed close to the drill bit. This allows directional decisions to be made sooner than if the sensors are further away from the drill bit. Further, the operational capacity of such tools to remain downhole may often be limited by the life of the battery.

Accordingly, it may be advantageous to provide batteries in segments that are distant from the segment housing the sensors, in order to help position the sensors in a specifically desired location. Remote battery segments may also allow the use of larger batteries and thereby improve the operational capacity of various tools. In such cases, in which remote battery segments are utilized, reliable, uninterrupted, electrical communication between segments tends to increase in importance.

Connection issues between segments are not limited to electrical power considerations. Segments including the sensor portion (e.g. the "logging string") of a drill string are often selected from a range of segment options based on needs of the particular application. The ability to interconnect multiple transmission lines (e.g., including data and other communication lines) between segments facilitates such flexibility in locating modular tool segments within the logging string. For example, increased numbers of communication channels between segments become available for transmitting logging data and receiving commands. This in turn allows sensors to be placed in segments that are distant from other segments in which, for example, a downhole-to-surface communication device has been deployed, or in which a central memory device has been deployed. The memory may receive data from the sensors for later download and retrieval when the drill string is brought to the surface.

The task of interconnecting multiple transmission lines between drill collar segments has been problematic in the MWD industry. Typically MWD tools must be designed to withstand shock levels in the range of 500 G on each axis, plus vibration levels of 25 G root mean square and pressures of 25,000 psi. The electrical connections between segments can often be the eventual point of failure. Multiple-transmission line connections are particularly susceptible to failure due to fluid (e.g., drilling fluid) ingress during MWD operations, causing shorts between the exposed surfaces of contacts. A connection that employs multiple fluid-resistant barriers would be advantageous. It would also be advantageous to minimize possible points of fluid entry into the contact area as well as to provide a connection that is inherently tolerant to small amounts of fluid ingress.

Conventional male and female electrical connectors, particularly in MWD service, have required a fairly high precision in longitudinal positioning within, for example, a tool body or drill collar, to ensure correct mating of the male and female electrical connectors when adjoining tool bodies or drill collars are assembled. Such precision is not always easy to achieve in manufacturing processes, not withstanding the availability of adjustable length barrels of calculated or set length designed to facilitate such precise longitudinal positioning. It would tend to be advantageous for mating male and female electrical connectors to include mechanisms to account for small variations in the calculated or set length of such adjustable extension barrels.

Therefore, there is a need in the art for an improved electrical connector addressing shortcomings of the prior art, including one or more of the shortcomings described above.

SUMMARY OF THE INVENTION

The present invention addresses one or more of the above-described shortcomings of prior art electrical connectors used in wet environments such as downhole applications. Referring briefly to the accompanying figures, aspects of this invention include an electrical connector for interconnecting multiple power and/or communication (e.g., data) transmission lines. The electrical connector includes male and female connector assemblies. A male pin assembly having a plurality of annular contacts is configured to repeatedly engage and disengage with a female socket assembly having a corresponding plurality of ring contact assemblies. Various exemplary embodiments further include retractable members deployed for sealingly isolating the annular contacts and the ring contact assemblies from fluids exterior to the male and female connector assemblies, respectively. In other exemplary embodiments the male pin assembly may be deployed for resilient longitudinal movement, thereby enabling the plurality of annular contacts to remain properly aligned with the plurality of ring contact assemblies. In still other exemplary embodiments, the female socket assembly may be deployed in a fluid filled chamber in a female connector assembly housing.

Exemplary embodiments of the present invention advantageously provide several technical advantages. Various embodiments of the electrical connector of this invention may maintain viable, uninterrupted electrical contact of multiple data and/or transmission lines at the extreme temperatures, pressures, and mechanical shocks frequent in downhole environments. MWD tools embodying electrical connectors of this invention may thus exhibit improved reliability as a result of the improved robustness to the downhole environment. The use of embodiments of this invention in downhole tools may also advantageously promote field service flexibility. For example, various MWD modules embodying this invention may readily be replaced or repositioned in a drill string in the field. Embodiments of this invention may also advantageously obviate the need for precision longitudinal positioning in a drill collar and thus may save time, reduce operational expenses, and improve the modularity of tools embodying the invention.

In one aspect this invention includes a male connector assembly for a matched male and female electrical connector pair. The male connector assembly includes a housing having a longitudinal axis and an opening on one end thereof. The male connector assembly also includes a male pin assembly deployed in the housing, the male pin assembly including a plurality of male contact members sized and shaped for selectively making and breaking electrical contact with a corresponding plurality of female contact members on a corresponding female connector assembly. The male pin assembly is coupled to a floating carrier, which is configured to displace along the longitudinal axis between a first floating carrier position and a second floating carrier position. The first floating carrier position is located nearer to opening than the second floating carrier position. The male connector assembly further includes a substantially annular wiper piston deployed about the male pin assembly and interposed between the floating carrier and the opening. The wiper piston is configured to displace along the longitudinal axis between a first wiper piston position and a second wiper piston position, the first wiper piston position located nearer to the opening than the second wiper piston position. The wiper piston is also disposed to sealingly isolate at least one of the plurality of male contact members from the opening when the wiper piston is in the first wiper piston position.

In another aspect this invention includes a female connector assembly for a matched male and female electrical connector pair. The female connector assembly includes a housing having a longitudinal axis and an opening on one end thereof, the housing providing an internal chamber between first and second bulkheads, the internal chamber disposed to be filled with a fluid. The female connector assembly further includes a female socket assembly having a plurality of female contact members, the female socket assembly deployed in the internal chamber of the housing. The plurality of female contact members are sized and shaped for selectively making and breaking electrical contact with a corresponding plurality of male contact members on a corresponding male connector assembly. The female connector assembly still further includes an internal housing deployed in the internal chamber of the female housing, the internal housing providing a fluid-balancing chamber between a fluid balancing piston and the first bulkhead. The fluid-balancing piston is configured to displace along the longitudinal axis between first and second fluid-balancing piston positions in the fluid-balancing chamber. The fluid-balancing chamber has a first volume when the fluid-balancing piston is in its first position and a second volume when the fluid-balancing piston is in its second position. The difference between the first and second volumes is substantially equal to a volume of the fluid displaced in the internal chamber by a male pin on the corresponding male connector assembly when the male and female assemblies are connected.

The foregoing has outlined rather broadly the features and technical advantages of the present invention in order that the detailed description of the invention that follows may be better understood. Additional features and advantages of the invention will be described hereinafter, which form the subject of the claims of the invention. It should be appreciated by those skilled in the art that the conception and the specific embodiment disclosed may be readily utilized as a basis for modifying or designing other structures for carrying out the same purposes of the present invention. It should be also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
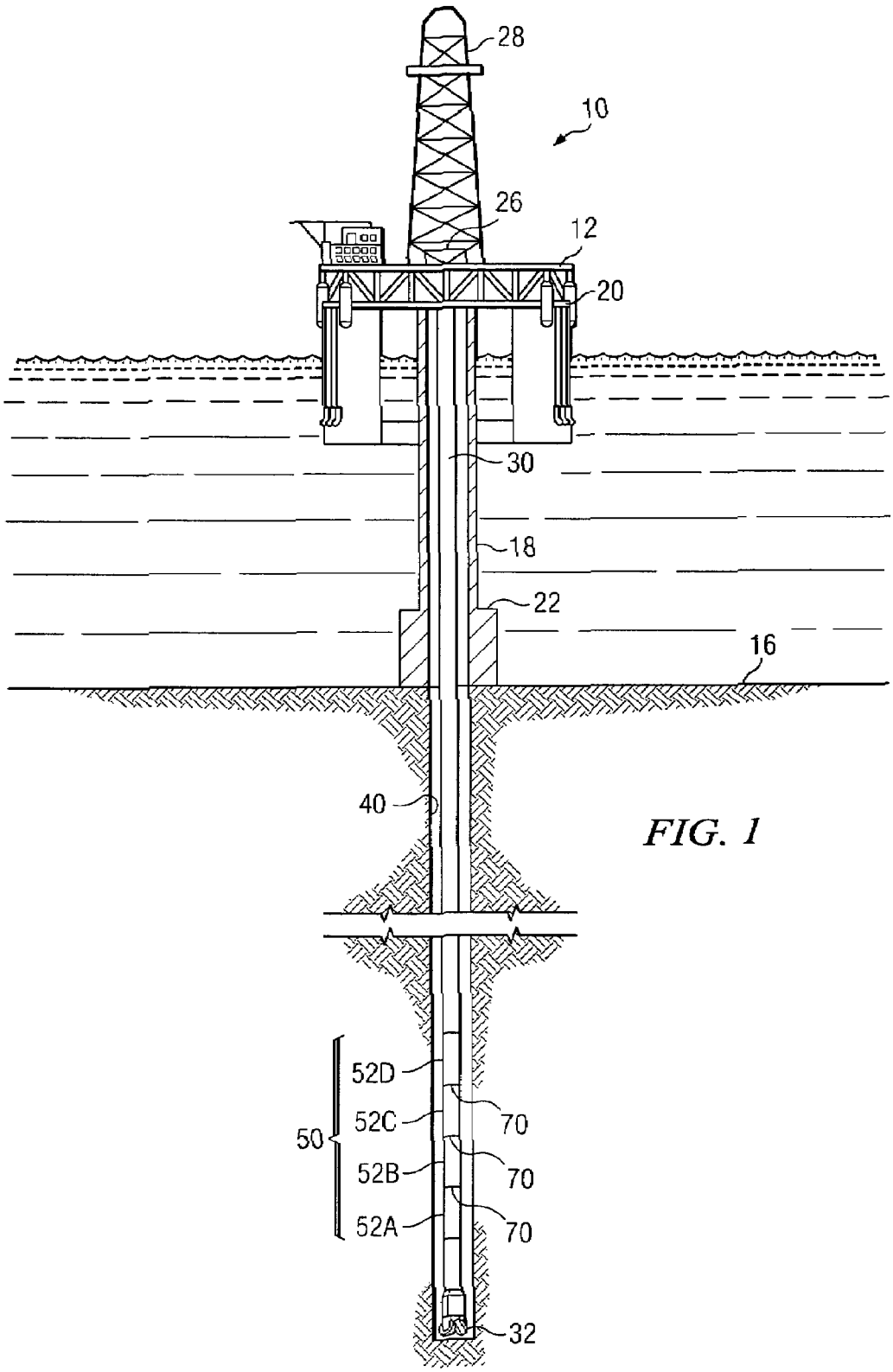
FIG. 1 is a schematic representation of an offshore oil and/or gas drilling platform utilizing an exemplary embodiment of the present invention.

FIG. 1 schematically illustrates one exemplary embodiment of a measurement while drilling (MWD) tool 50 according to this invention in use in an offshore oil or gas drilling assembly, generally denoted 10. In FIG. 1, a semisubmersible drilling platform 12 is positioned over an oil or gas formation (not shown) disposed below the sea floor 16. A subsea conduit 18 extends from deck 20 of platform 12 to a wellhead installation 22. The platform may include a derrick 26 and a hoisting apparatus 28 for raising and lowering the drill string 30, which, as shown, extends into borehole 40 and includes a drill bit 32 and MWD tool 50.

With continued reference to FIG. 1, MWD tool 50 includes a plurality of threadably coupled MWD modules 52A, 52B, 52C, and 52D (referred to in common as MWD modules 52A–D) in electrical communication with one another. In the embodiment shown, MWD modules 52A–D are coupled end to end (i.e., module 52A is coupled to module 52B, which is coupled to module 52C and so on as shown) via electrical connectors 70. Individual MWD modules 52A–D may include substantially any MWD components, such as various sensor modules including one or more sensors such as acoustic sensors, nuclear magnetic resonance sensors, resistivity sensors, dielectric sensors, magnetic field sensors, gravity sensors, gamma ray depth detection sensors, pressure sensors, temperature sensors, optical sensors, density sensors, viscosity sensors, pH sensors, and the like. Individual MWD modules 52A–D may also include surface to downhole communication modules, such as mud pulse telemetry, fluid sampling modules, power modules, and the like. Electrical connectors 70 are configured to provide power and/or data communication between adjacent MWD modules 52A–D over a plurality of transmission lines as described in more detail below.

Modular MWD tool 50 may be advantageous in that it promotes field service flexibility. For example, damaged (or otherwise inoperable) MWD modules 52A–D may be replaced in the field without replacing the entire MWD tool 50 (at potentially significant savings in cost and time). Alternatively, particular MWD modules (including particular sensors) may be deployed at substantially any position relative to one another and within the MWD tool 50 (e.g., proximate or distal to drill bit 32). Decisions regarding such deployment may be made in the field in substantially real time. Such positioning of the MWD modules 52A–D may even be changed during a drilling operation. For example, during drilling, modules including surveying sensors (e.g., magnetometers and accelerometers) may be positioned proximate to drill bit 32. After penetration of a formation of interest, modules including logging sensors (e.g., acoustic, resistivity, and nuclear magnetic resonance sensors) may be repositioned to be proximate to drill bit 32.

In this disclosure, the term MWD will be used to describe both logging while drilling (LWD) and measurement while drilling (MWD) measurements. As used in the art, there is not always a clear distinction between the terms LWD and MWD. Generally speaking, MWD typically refers to measurements taken for the purpose of drilling the well (e.g., navigation) whereas LWD typically refers to measurement taken for the purpose of analysis of the formation and surrounding borehole conditions. Nevertheless, as stated above, the term MWD is used herein to describe both types of measurements.

It will be understood by those of ordinary skill in the art that the modular MWD tool 50 of the present invention is not limited to use with a semisubmersible platform 12 as illustrated in FIG. 1. MWD tool 50 is equally well suited for use with any kind of subterranean drilling operation, either offshore or onshore. It will further be understood that although the deployments and embodiments described herein are directed to subterranean applications, that electrical connectors 70 according to the present invention are not limited to downhole applications such as illustrated on FIG. 1. Embodiments of this invention may be useful in a wide range of applications requiring coupling of multiple signal and/or power conduits, especially in wet, or otherwise harsh environments. For example, tools employing the present invention may be used for wire-line applications, seismic-type applications and sub-sea applications. Alternatively, the present invention may be deployed on submerged power lines or pipelines.

Figure 2A:
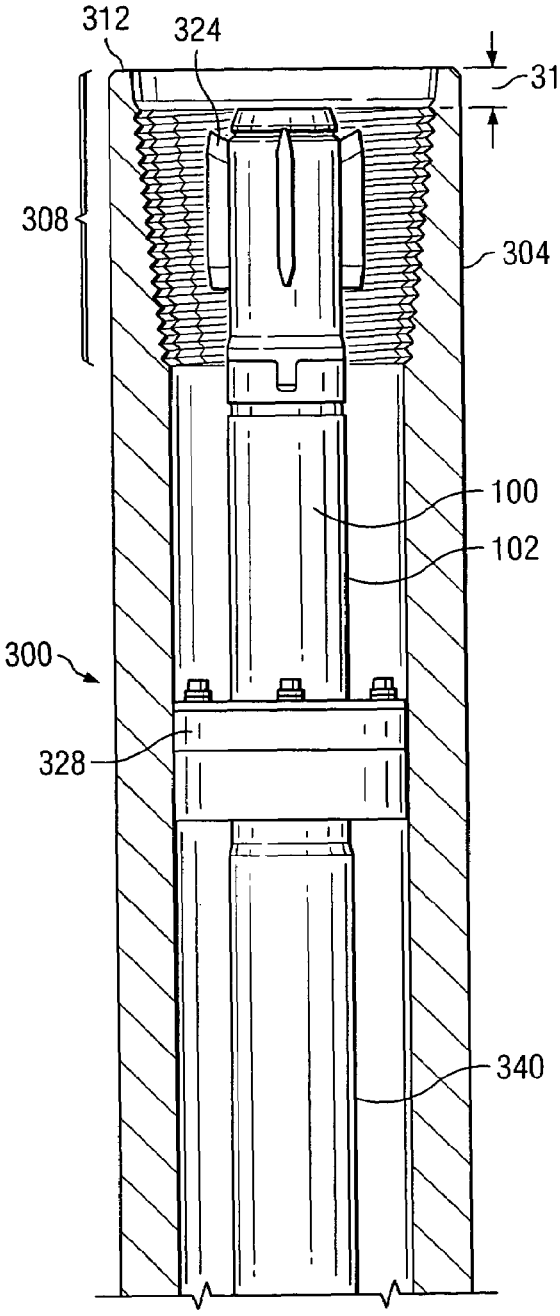
FIGS. 2A and 2B depict portions of exemplary drill collar segments on which connector assemblies according to the present invention may be deployed.
Figure 2B:
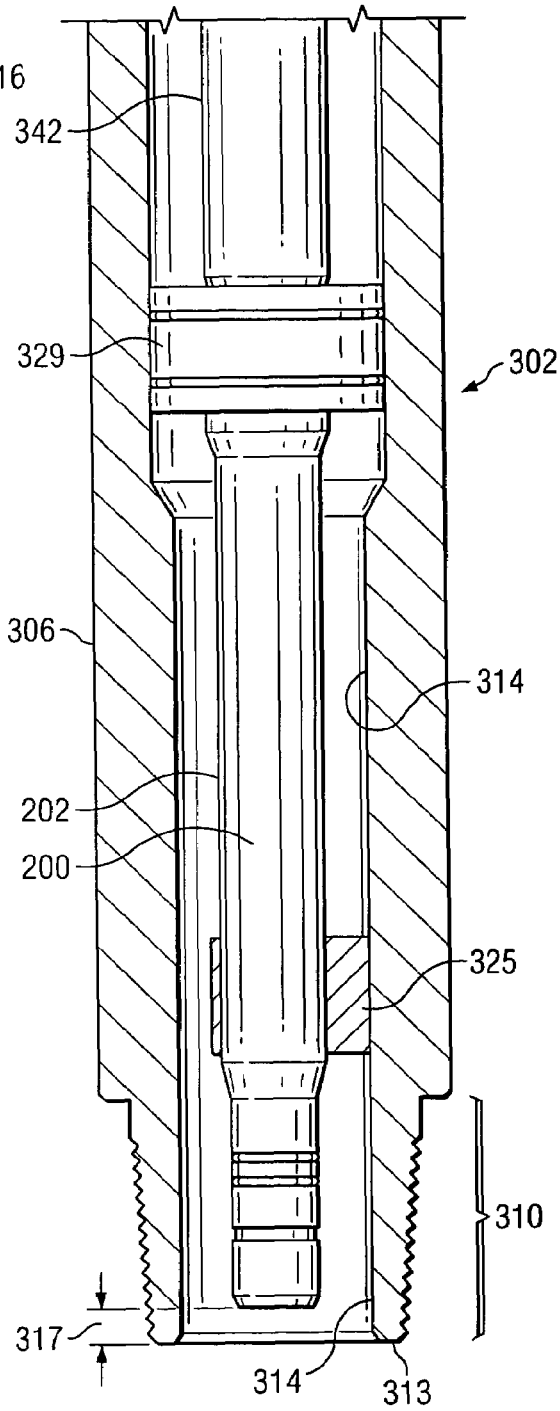

With reference now to FIGS. 2A and 2B, exemplary connector portions 300, 302 of MWD modules 52A–D (FIG. 1) are shown. Connector portions 300, 302 include male and female multi-pin connector assemblies 100, 200, respectively, deployed in sections of drill collar 304, 306. In the exemplary embodiment shown, drill collar sections 304, 306 include threaded end portions 308, 310 for threadably coupling one to another. In exemplary MWD embodiments, such threaded end portions may be utilized, for example, to configure a modularized MWD tool 50 from a plurality of MWD modules 52A–D as described above with respect to FIG. 1. Such MWD modules may include, for example, a male electrical connector assembly deployed in one threaded end of the drill collar (e.g., as shown in FIG. 2A) and a female electrical connector assembly deployed in an opposing threaded end of the drill collar (e.g., as shown in FIG. 2B). In exemplary MWD embodiments, drill collars 304, 306 may include an outer diameter ranging from about 4¾ to about 9½ inches with threaded end portions 308, 310 ranging in length from about 3⅞ to about 4⅞ inches.

Despite appearances on the illustrations of FIGS. 2A and 2B, component 100 on FIG. 2A is designated in this disclosure as a "male connector assembly", and component 200 on FIG. 2B is designated as a "female connector assembly". This convention is based on the configuration of connecting parts within male and female connector assemblies 100, 200. It will be seen on FIG. 3A that male pin 104 (shown also in isolation on FIGS. 4A through 4D) is deployed inside component 100. Hence, component 100 is designated in this disclosure as a "male connector assembly". Likewise, it will be seen on FIG. 5B that shroud portion 204 on component 200 includes both a female receptacle (lower bulkhead 211), and a female socket assembly 240 with a plurality of ring contacts assemblies 241, 242, 243 (also shown in isolation on FIGS. 6A and 6C), for receiving male pin 104. Hence item 200 is designated in this disclosure as a "female connector assembly". It will be further understood that these designations and conventions of "male" and "female" are for ease of reference in the disclosure only, and are not intended to be limitations on the invention.

Figure 7A:
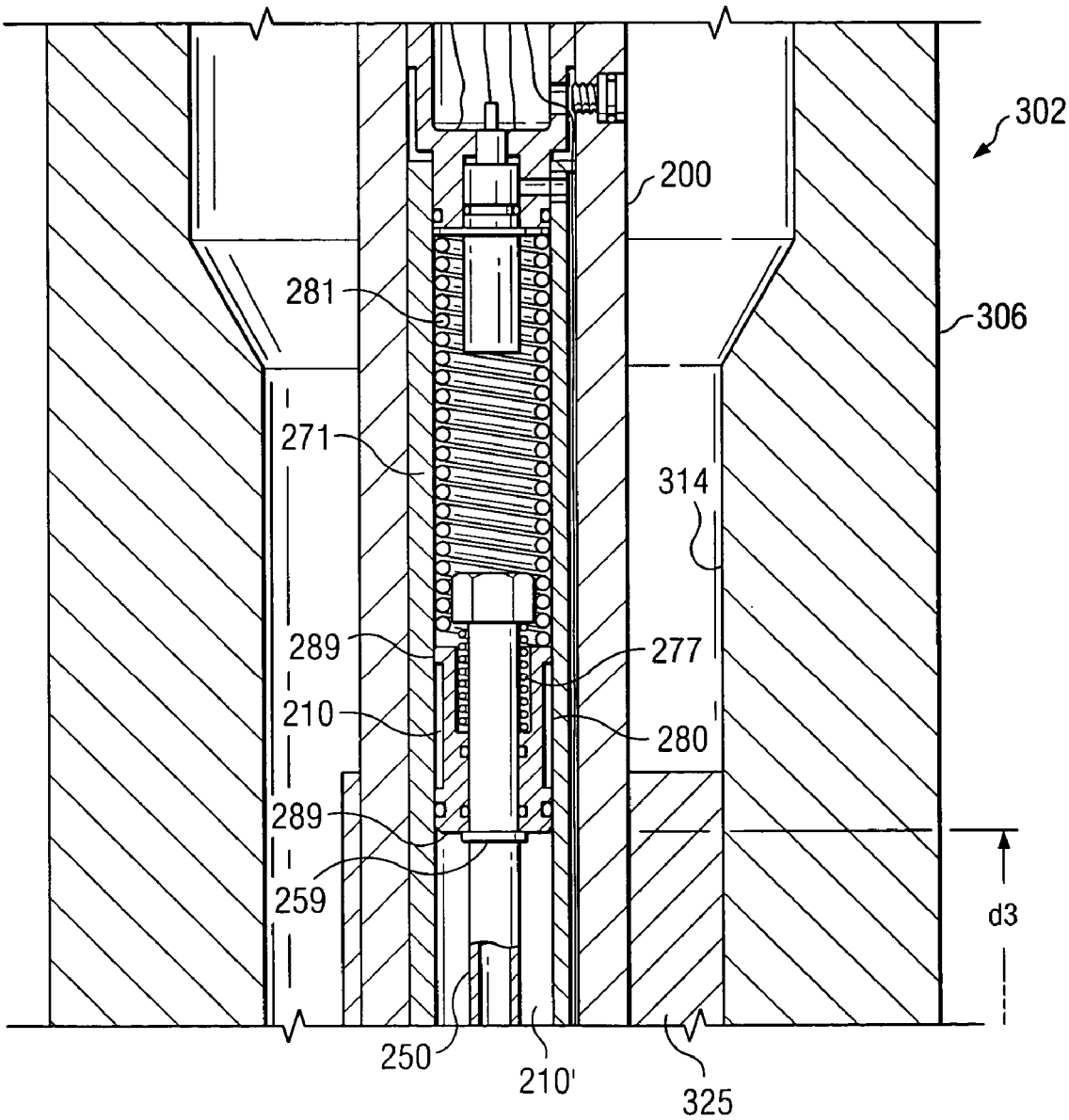
FIGS. 7A and 7B depict in cross section the connector assemblies of FIGS. 2A and 2B in the connected state.
Figure 7B:
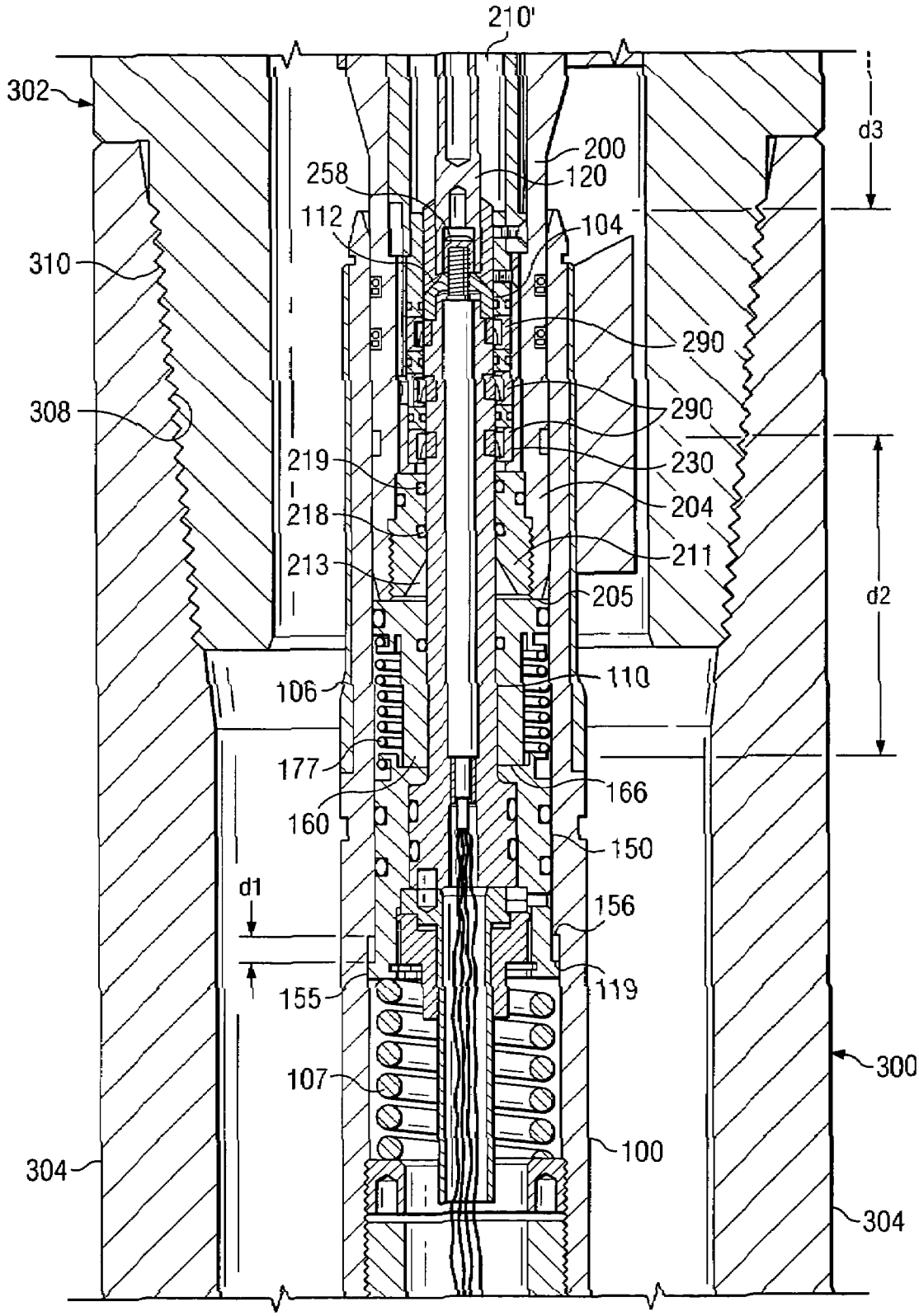

With continued reference to FIGS. 2A and 2B, in an exemplary downhole embodiment, a multi-contact male connector assembly 100 is deployed within a lower connector portion 300, and is configured to interconnect with a corresponding female connector assembly 200 deployed within an upper connector portion 302 (shown interconnected in more detail on FIGS. 7A and 7B). It will be appreciated, however, that the invention is not limited to any particular orientation of connector assemblies 100, 200 and/or connector portions 300, 302. Other embodiments may deploy connector assemblies 100, 200 upside down from the arrangement shown on FIGS. 7A and 7B, or in any other horizontal, vertical or inclined orientation. Terms used in this disclosure such as "upper" and "lower" are intended merely to show relative positional relationships of various components, as deployed, for example, in an exemplary embodiment intended for MWD service, and are not limiting of the invention in any way.

As will be described in greater detail below with respect to FIGS. 7A and 7B, exemplary embodiments of male and female connector assemblies 100, 200 are adapted to interconnect a plurality of data and/or power transmission lines while the upper and lower drill collar segments 304, 306 are threadably engaged. Disconnection of the connector assemblies 100, 200 occurs upon threadable disengagement of drill collar segments 304, 306. Male and female connector assemblies 100, 200 are further adapted, in normal operation, to repeatedly connect and disconnect with minimized replacement or refurbishment of components in either connector assembly 100, 200 prior to each connection.

With further reference to FIGS. 2A and 2B, male and female connector assemblies 100, 200 each include a substantially tubular (cylindrical) housing 102, 202. Tubular housings 102, 202 may be fabricated from substantially any suitable material, however, titanium alloys may be preferable for certain downhole applications. Tubular housings 102, 202 are mechanically coupled to removable and adjustable extension barrels 340, 342 through centralizers 328, 329, which maintain the extension barrels 340, 342 and tubular housings in a substantially coaxial position with respect to drill collar segments 304, 306. Centralizers 328, 329 also function to stabilize the male and female connector assemblies 100, 200 against excessive vibration.

In various exemplary MWD embodiments the male and female connector assemblies 100, 102 may be recessed in from the distal edges 312, 313 of threaded portions 308, 310 as shown at 316 and 317, respectively. Such recessing (e.g., from about half to about three quarters of an inch in certain exemplary embodiments) serves to substantially shield the connector assemblies 100, 200 from handling damage prior to mating engagement. The depths 316, 317 of such recesses may be readily adjusted by removing extension barrels 340, 342 and adjusting the lengths thereof. It is common that the length of a drill collar segment may need to be altered to remove, for example, worn and/or damaged threads on threaded portions 308, 310. After removal, new threads may need to be cut into the ends of the drill collar segment. Having spacer functionality in extension barrels 340, 342 allows such adjustments in length to occur while preserving longitudinal spacing of connector assemblies 100, 200.

With still further reference to FIGS. 2A and 2B, the male and/or the female connector assemblies 100, 200 may optionally be fitted with one or more stabilizer fins 324, 325. In the exemplary embodiment shown in FIGS. 2A and 2B, stabilizer fins 325 extend radially outward from tubular housing 202 of the female connector assembly 200 into contact with an inner surface 314 of drill collar segment 306 and are intended to stabilize the female connector assembly 200 coaxially in drill collar section 306. Likewise, stabilizer fins 324 extend radially outward from tubular housing 102 of the male connector assembly 100 and are intended to promote coaxial alignment of the threaded portions 308, 310 of the drill collar segments 304, 306 during mating of the two connector assemblies 100, 200.

Routing of Electric Lines

As described above, embodiments of this invention provide for electrical connection of a plurality of data and/or power transmission lines between two components, for example, two adjacent drill collar segments. As such, with brief reference to FIGS. 3A, 3B, 5A, and 5B, routing of the electrical signal and power transmission lines will be described next for the exemplary embodiments shown. A detailed description of the same embodiments is then provided, including a detailed description of male connector assembly 100 (FIGS. 3A through 4D), female connector assembly 200 (FIGS. 5A through 6C), and the connecting and disconnecting thereof (FIGS. 7A and 7B) in those embodiments. While the exemplary embodiment described includes four electrical signal and/or power transmission lines (e.g., three data and one power transmission line), it will be understood that this invention is not limited to any particular number thereof.

Figure 3A:
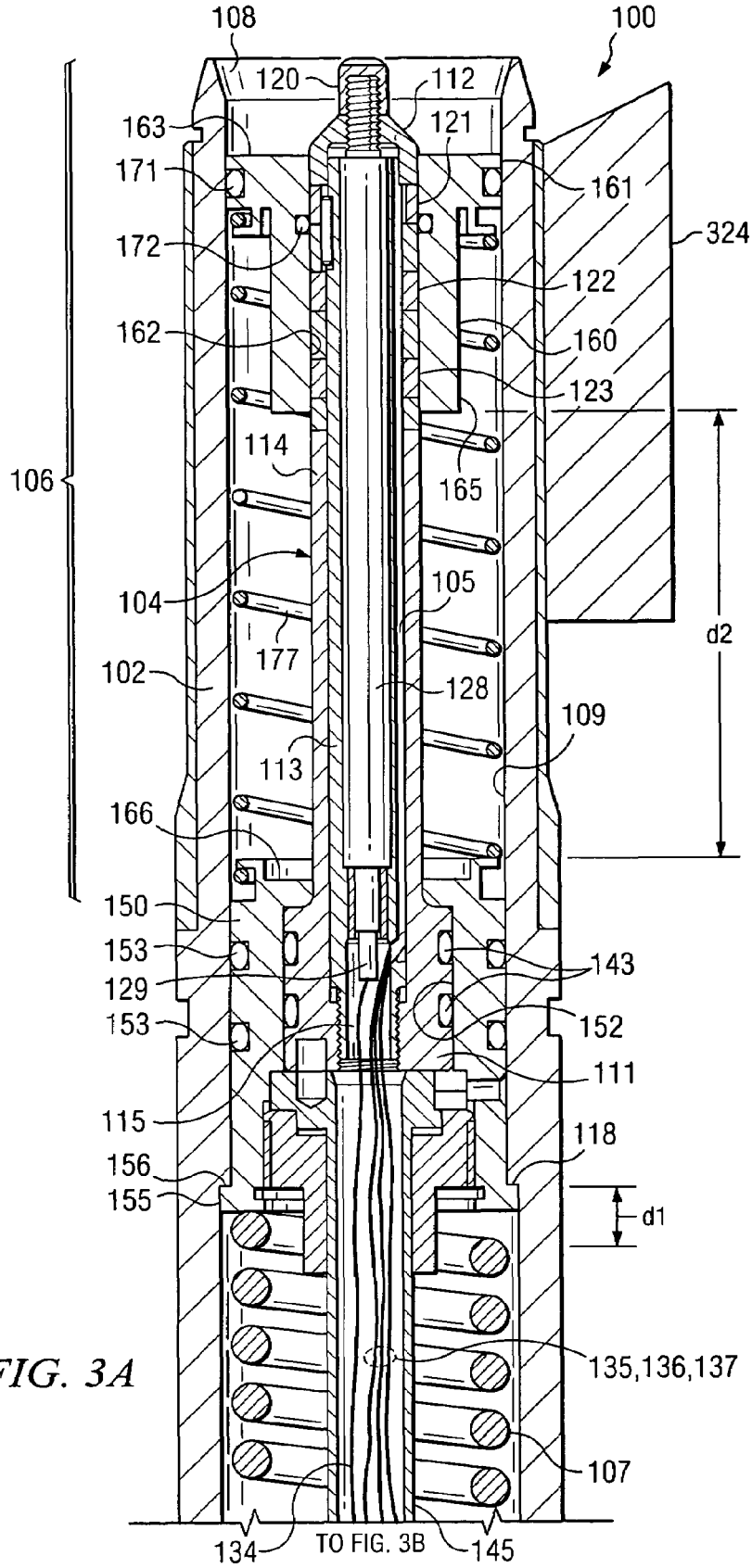
FIGS. 3A and 3B depict in cross section a portion of one embodiment the male connector assembly shown in FIG. 2A.
Figure 3B:
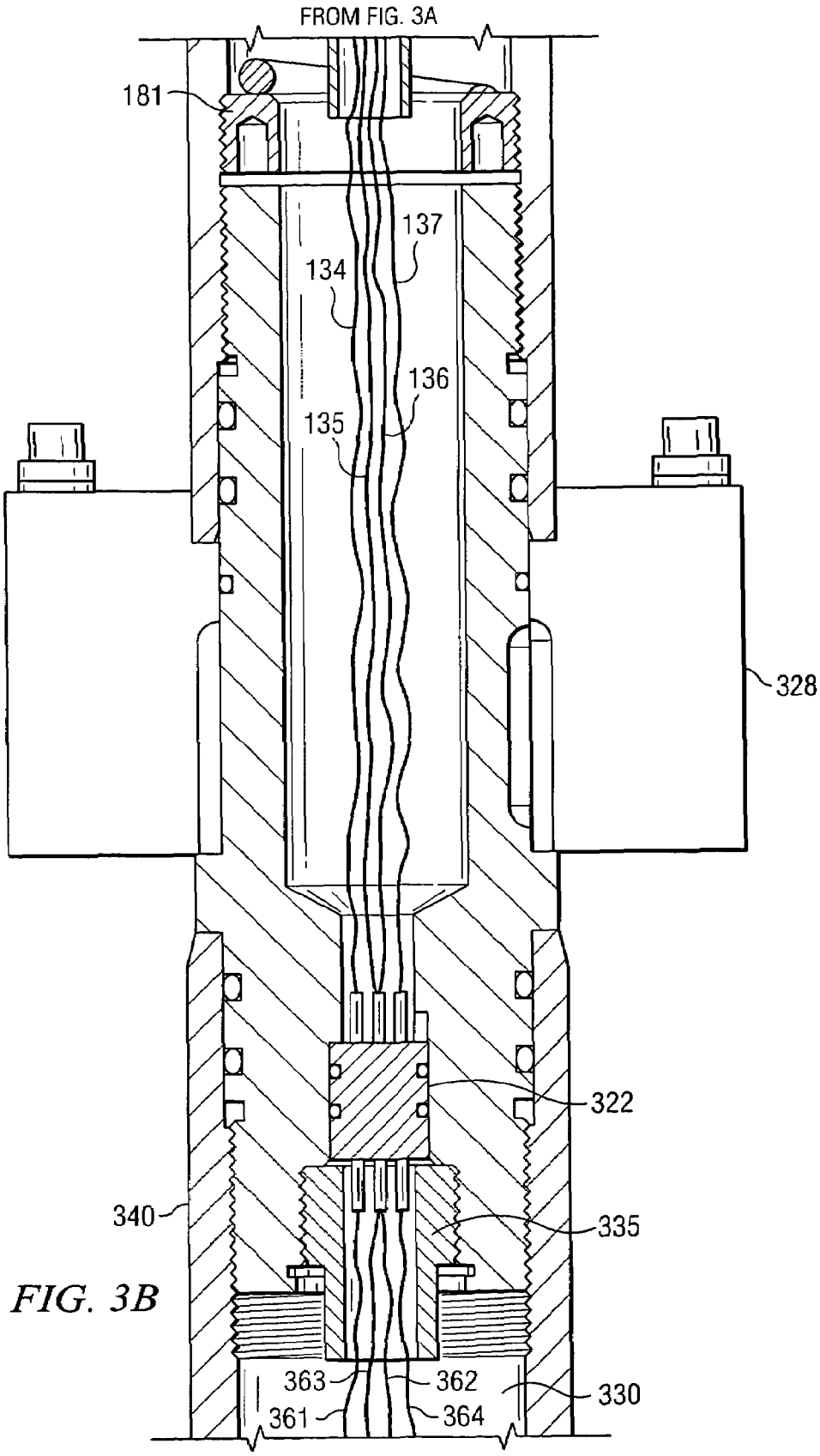

With brief reference now to FIG. 3B, routing of the electrical signal and power transmission lines is shown for the male connector assembly 100. Electrical conductors (e.g., wires) 361, 362, 363, 364 are coupled to an exemplary MWD module (e.g., a sensor, battery pack, or telemetry device) via a four conductor socket assembly (not shown). In the embodiment shown, conductors 361, 362, 363, 364 are routed through extension barrel 340 and couple the MWD modules with an optional high-pressure connector 322. High-pressure connector 322 couples conductors 361, 362, 363, 364 to conductors 134, 135, 136, 137, which are routed upwards through male connector assembly 100 into tube 145. Exemplary high-pressure connectors 322 may be rated, for example, to withstand pressures of up to 25,000 psi. Use of a high-pressure connector 322 may be preferable for MWD embodiments since it tends to resist the ingress of fluid into the interior 330 of the extension barrel 340. However, it will be understood that this invention is not limited to embodiments deploying a high-pressure connector 322.

With brief reference now to FIG. 3A, conductors 134, 135, 136, 137 are routed through tube 145 to bore 115 in lower housing 114 of male pin 104. Conductor 134 is coupled to pin 129 of conductive rod 128, which electrically couples conductor 134 to center contact 120. Conductors 135, 136, 137 are routed through bore 115 to individual longitudinal grooves as exemplified by groove 105 in insulator sleeve 113. Conductors 135, 136, 137 are further routed through the longitudinal grooves and coupled to annular contacts 121, 122, 123 (also shown in FIG. 4D). In the embodiment shown, center contact 120 is connected directly to conducting rod 128, and is thereby suited, if desired, to carry high levels of current (e.g., from a power source such as an MWD battery collar). Conductors 135, 136, 137, which are connected to annular contacts 121, 122, 123, may then be configured for electronic communication, such as data transmission, for example, via conventional RS485 or network bus conductors. Center contact 120 and annular contacts 121, 122, 123 are configured and deployed for coupling signal and/or power transmission lines from male connector assembly 100 to contacts 254, 241, 242, 243 in female connector assembly 200 as described in more detail below.

Figure 5A:
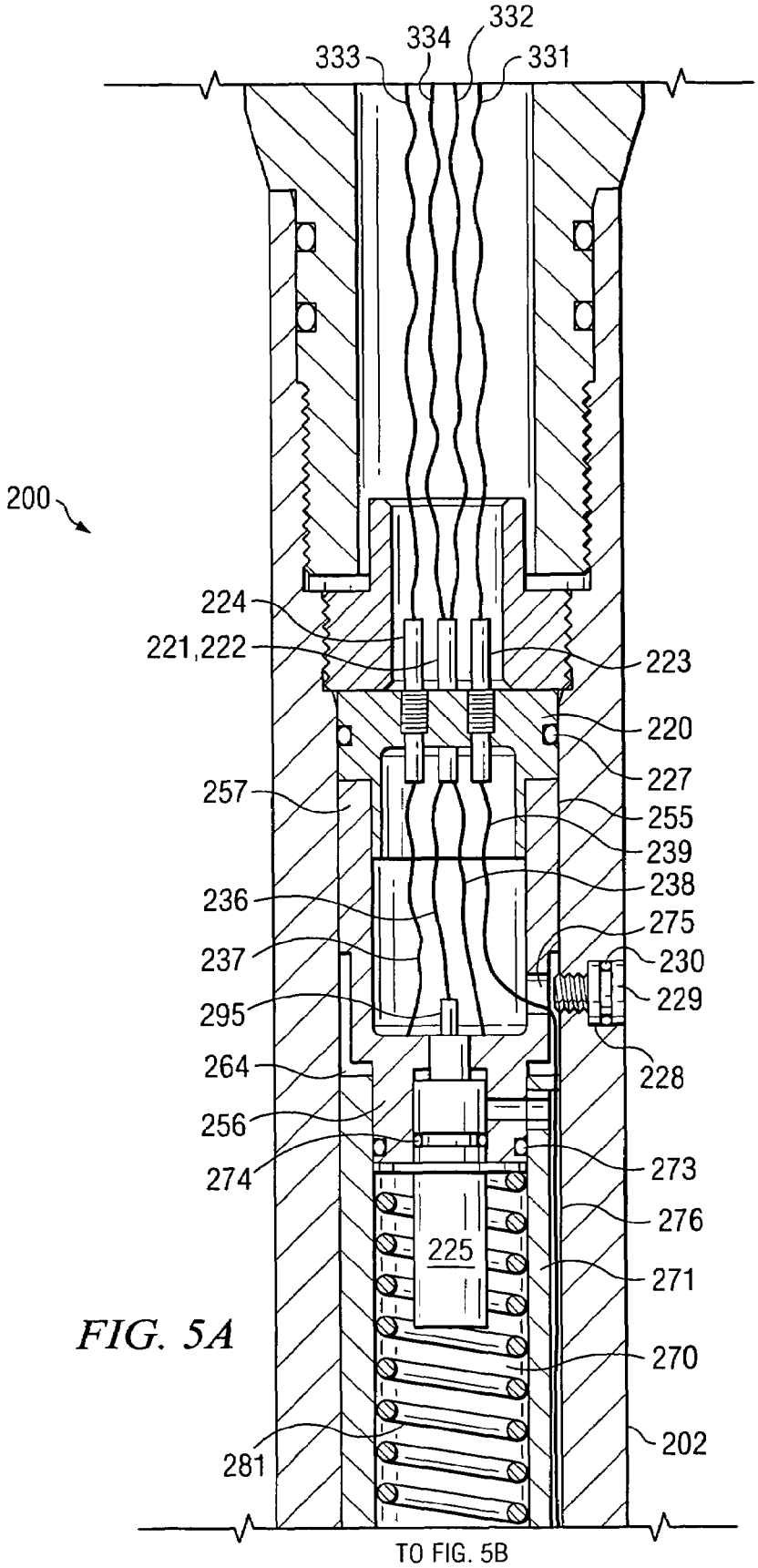
FIGS. 5A and 5B depict in cross section a portion of one embodiment the female connector assembly shown in FIG. 2B.
Figure 5B:
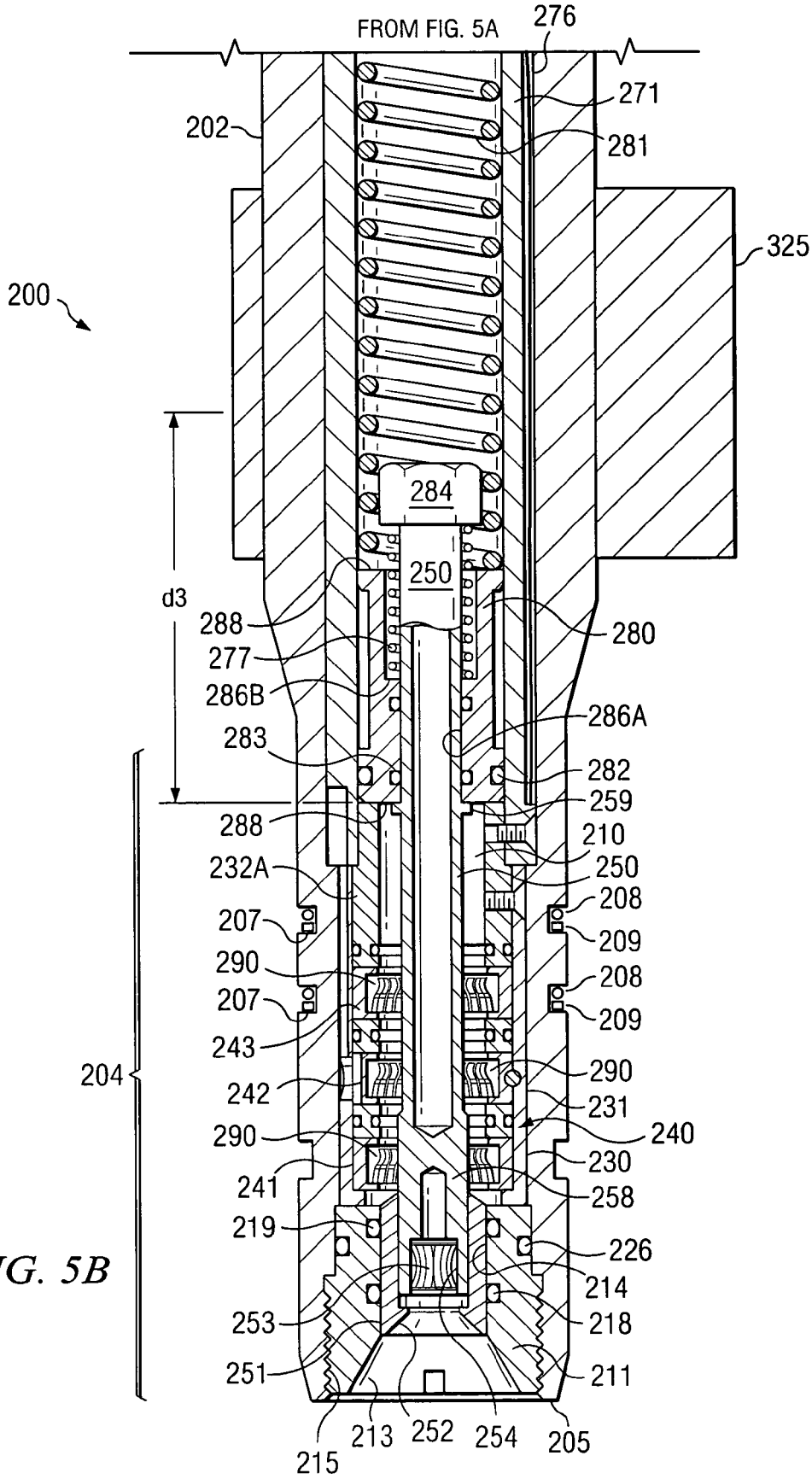
Figure 5C:
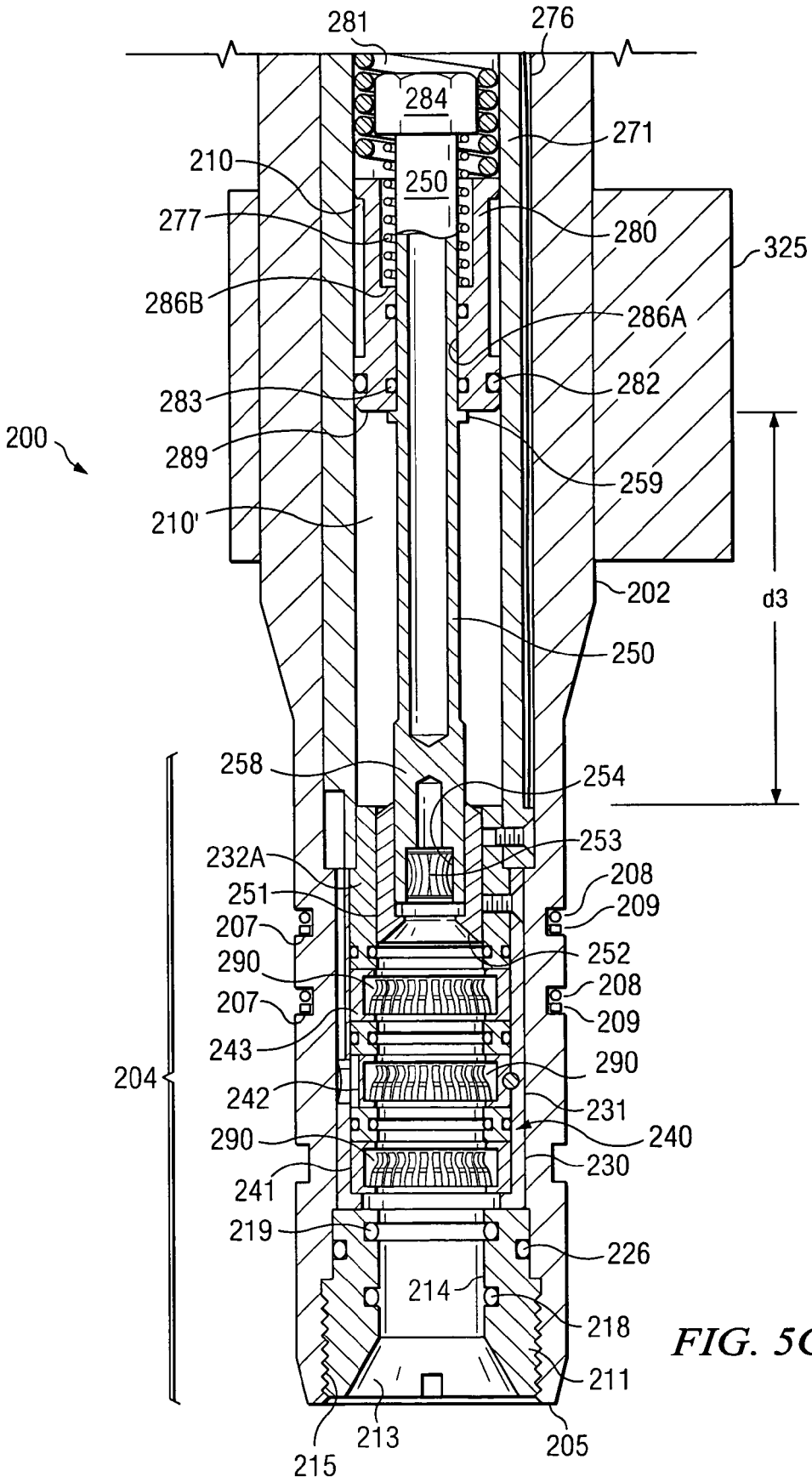
FIG. 5C depicts in cross section a portion of the female connector assembly shown in FIG. 5A in a compressed configuration.
Figure 6A:
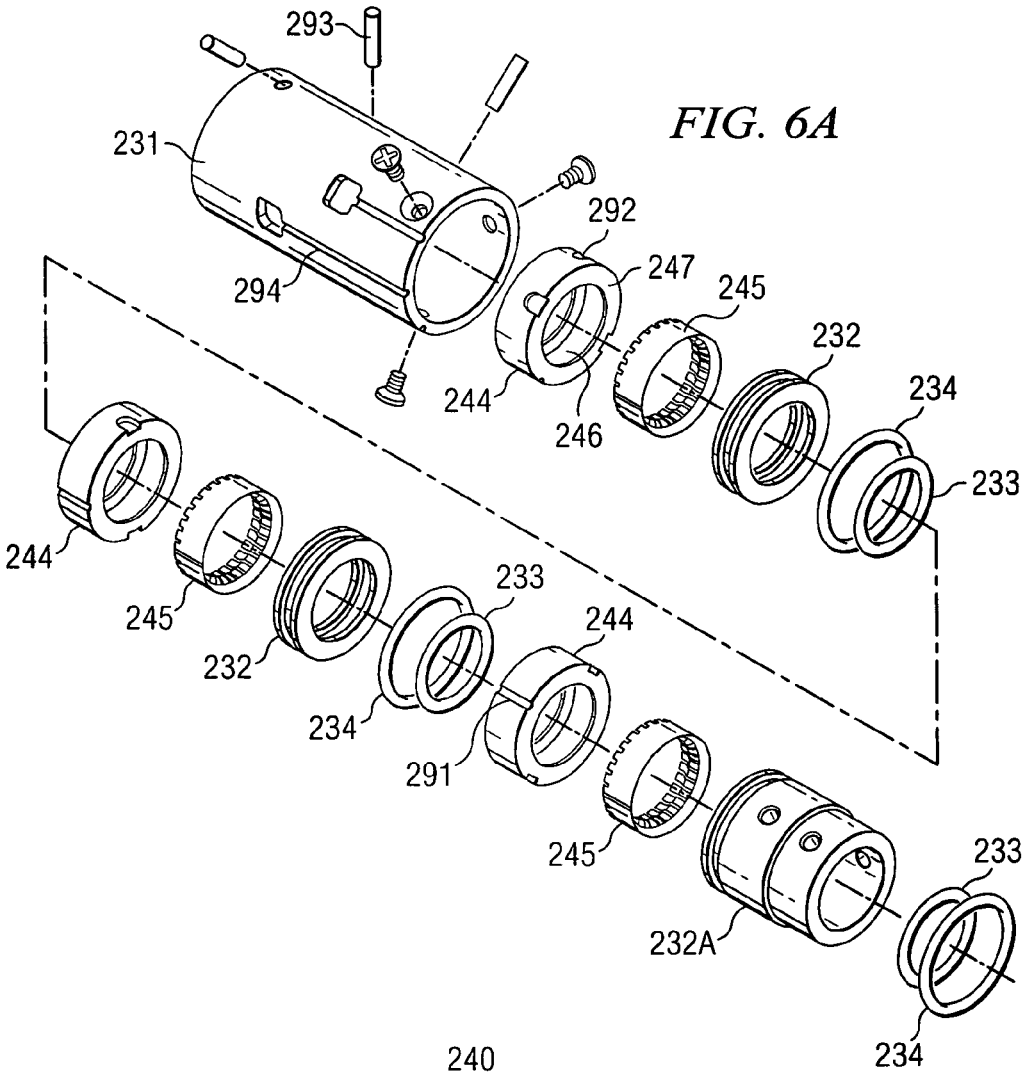
FIG. 6A is an exploded view of the female socket assembly portion of the female connector assembly shown in FIG. 5B.

With brief reference now to FIG. 5B, female center contact 254 is configured for receiving and electrically coupling with male center contact 120 (FIG. 3A). In the embodiment shown, female center contact 254 includes a center flexible contact insert 253 (formed for example from gold plated copper) provided in and in electrical contact with a bore formed in a lower end 258 of conductive shaft assembly 250. Shaft assembly 250 is electrically coupled to conductive internal spring member 281 via nut 284 and/or conductive fluid-balancing piston 280. Female annular contact assemblies 241, 242, 243 are configured for receiving and electrically coupling with male annular contacts 121, 122, 123 (FIG. 3A). In the embodiment shown, female annular contact assemblies 241, 242, 243 are electrically coupled with conductors 237, 238, 239 (shown in FIG. 5A), which are routed through oil filled receptacle 210 to bulkhead connector assembly 220, for example, through grooves 276 deployed on the outer surface of oil balance housing 271 to grooves 294 deployed on the outer surface of female socket housing 231 (FIG. 6A).

With brief reference now to FIG. 5A, internal spring member 281 is electrically coupled to spring terminal 225, which is in turn coupled through pin 295 to conductor 236. Conductors 236, 237, 238, 239 are electrically coupled to conductors 331, 332, 333, 334 via bulkhead connector assembly 220. Conductors 331, 332, 333, 334 are routed upward to a high-pressure connector (not shown), such as item 322 described above in male connector assembly 100 with respect to FIG. 3B. The high-pressure connector in female connector assembly 200 will be understood to be typically coupled via electrical conductors (not shown) to a four conductor socket assembly (not shown). It will be understood that the various conductors (e.g., wires) utilized in exemplary embodiments of this invention may include high temperature insulation.

Male Connector Assembly

With reference now to FIGS. 3A through 4D, exemplary embodiments of a male connector assembly 100 according to this invention are described in more detail. FIGS. 3A and 3B depict male connector assembly 100 in the disconnected state. Referring to FIG. 3A, male connector assembly 100 includes a tubular housing 102 having a hollow cylindrical sleeve portion 106 and a borehole 109 with an open end 108. As described in further detail below, borehole 109 is sized and shaped to receive shroud portion 204 (FIG. 5B) of female connector assembly 200. Male connector assembly 100 further includes a male pin assembly 104 (see also FIGS. 4A through 4D) deployed substantially coaxially within housing 102. As described briefly above, and in more detail below with respect to FIGS. 4A through 4D, male pin assembly 104 includes a plurality of contact members 120, 121, 122, 123 configured for making electrical contact with corresponding contacts 254, 241, 242, 243 in female connector assembly 200 (FIG. 5B).

With continued reference to FIG. 3A, exemplary embodiments of male connector assembly 100 further include a retractable wiper piston 160 deployed about and substantially coaxially with male pin assembly 104 at a rest position near open end 108. Wiper piston 160 is generally cylindrical in shape, having a through bore 162 into which male pin 104 is received. Wiper piston 160 is deployed to engage and seal the inner cylindrical surface of male housing 102 via, for example, at least one o-ring 171 received in a corresponding annular groove in the outer cylindrical surface 161 of the wiper piston 160. The wiper piston 160 is also deployed to engage and seal with the outer cylindrical surface of male pin 104 via, for example, at least one o-ring 172 received in a corresponding annular groove on the inner cylindrical of the wiper piston 160.

With further reference to FIG. 3A, wiper piston 160 is coupled to a floating carrier 150 within housing 102 via a spring member 177. When the spring member 177 is in a substantially uncompressed state, the wiper piston 160 is maintained at a rest position with nose portion 112 (including contact 120) of male pin 104 generally protruding therefrom. As described in more detail below, mating of male and female connector assemblies 100, 200 causes face 205 of shroud portion 204 of female connector assembly 200 (FIG. 4B) to engage face 163 of wiper piston 160, and displace wiper piston 160 longitudinally against spring 177. Wiper piston 160 includes a longitudinal range of motion d2 (also referred to herein as the wiper piston range). Comparison of FIGS. 3A and 3C (as well as FIG. 7B) shows wiper piston 160 in two opposing end positions 165 and 166 within wiper piston range d2. Position 165 is a rest position at one end of the wiper piston range d2, while position 166 is a fully displaced position at the other end of the wiper piston range d2 in which spring member 177 is substantially fully compressed. Positions 165 and 166 correspond generally to male and female connector assemblies 100, 200 being in disconnected and connected states, respectively.

In one exemplary embodiment intended for MWD service, wiper piston range d2 is about 2.5 inches, although the invention is not limited in this regard. Similarly, in such an exemplary embodiment, spring 177 may be rated at from about 10 to about 20 pounds per compressed inch, although the invention is also not limited in this regard.

Figure 3C:
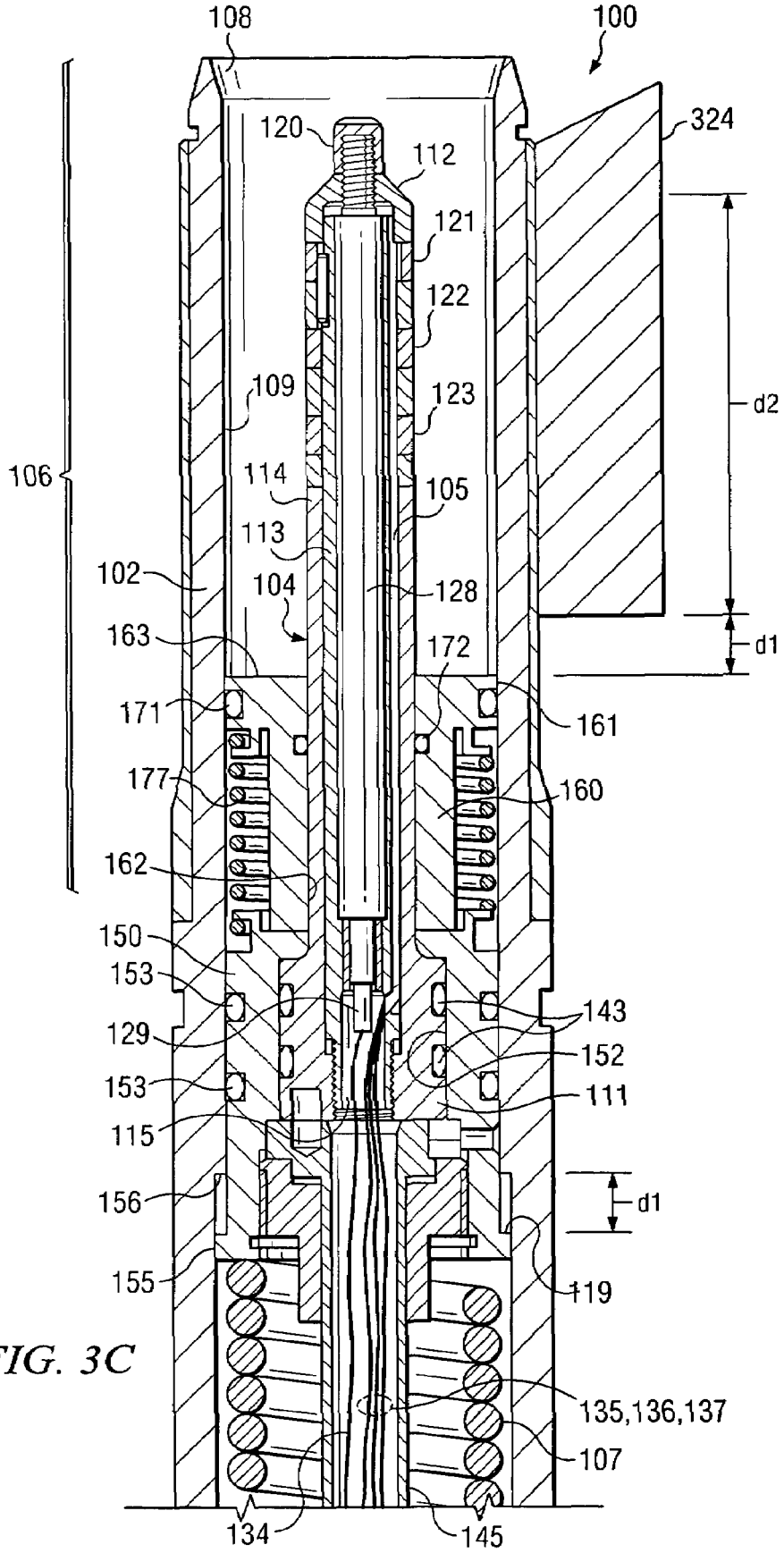
FIG. 3C depicts in cross section the portion of the male connector assembly shown in FIG. 3A in a compressed configuration.

It will be appreciated from FIGS. 3A and 3C that wiper piston 160 provides several advantageous features. These features include: (1) sealing the interior of male housing 102 (e.g., contacts 121, 122, 123) from fluid ingress when male connector assembly 100 is in the disconnected state; (2) wiping impurities that might discourage good electrical contact (e.g., oil, moisture, fluid, dirt, debris) from the annular male contacts 121, 122, 123 as male and female connector assemblies 100, 200 are brought together and mated, and then wiping them again as male and female connector assemblies 100, 200 are later disconnected; and (3) assisting coaxial alignment of nose portion 112 with receptacle entrance 213 (as shown on FIG. 5B) as male and female connector assemblies 100, 200 are brought together for mating.

One skilled in the art will recognize that, although not illustrated, the various features of the wiper piston 160 in an exemplary MWD service embodiment may also be provided by multiple components, rather than a single component as shown in FIGS. 3A and 3C.

With still further reference to FIG. 3A, floating carrier 150, like wiper piston 160, is deployed substantially coaxially in housing 102. Floating carrier 150 is deployed to engage and seal the inner cylindrical surface of housing 102 via, for example, at least one o-ring 153 disposed in corresponding grooves in the outer cylindrical surface of the carrier 150. Floating carrier 150 further includes a central bore 152 into which the base portion 111 (FIG. 4B) of the lower housing 114 of male 104 is received. Male pin 104 is typically sealed against the bore 152 of floating carrier 150 via one or more o-rings 143.

Floating carrier 150 is disposed to slide in housing 102 such that compression of heavy-duty spring 107 permits a range of longitudinal motion d1 (also referred to as a floating carrier range). Comparison of FIGS. 3A and 3C (as well as FIG. 7B) shows floating carrier 150 in two opposing end positions 118 and 119 within floating range d1. At rest position 118 (shown in FIG. 3A), annular boss 155 of floating carrier 150 abuts against shoulder 156 on male housing 102. At fully displaced position 119 (shown in FIG. 3C), heavy-duty spring 107 is substantially fully compressed. In one exemplary embodiment intended for MWD service, floating range d1 is about 0.5 inch, although the invention is not limited in this regard. In the embodiment shown, the heavy-duty spring 107 is deployed between the floating carrier 150 and a lock-nut 181 threadably engaged with housing 102.

While this invention is not limited to the use of heavy-duty spring 107, the floating range d1 provided by such a heavy-duty spring 107 advantageously reduces precision requirements for the lengths of adjustable extension barrels 340, 342 (FIGS. 2A and 2B). As described above with respect to FIGS. 2A and 2B, the lengths of adjustable extension barrels 340, 342 affect the longitudinal positions of male connector assembly 100 and female connector assembly 200 with respect to drill collar segments 300, 302, and thus, in the connected state, the longitudinal position of male connector assembly 100 with respect to female connector assembly 200.

Comparing FIGS. 2A and 2B with the assembled details shown on FIG. 7B, it may be seen that the length of adjustable extension barrels 340 and 342 may be calculated and set so as to expect correct longitudinal mating of male and female connector assemblies 100, 200 at a point placing floating carrier 150 within floating range d1. In such mating, as described in more detail below with respect to FIGS. 7A and 7B, female connector assembly 200 exerts a longitudinal force on male connector assembly 100 as male pin 104 is fully received into female connector assembly 200, thereby displacing male floating carrier 150 from rest position 118 towards displaced position 119. The interoperation of male floating carrier 150 and heavy duty spring 107 thus allows sliding displacement of male floating carrier 150 within floating range d1 to maintain correct longitudinal mating of male and female connector assemblies 100, 200, notwithstanding small variations in the calculated or set length of adjustable extension barrels 340, 342. Such small variations would be of the order of magnitude, for example, of +/−0.125 inches in the calculated or set lengths of each of the adjustable extension barrels 340, 342 in an embodiment of the invention intended for MWD service. In this way, contrary to the exactitude generally required in the prior art, it is no longer necessary to adjust or set the length of adjustable extension barrels 340, 342 to a degree of precision greater than floating range d1 prior to assembly of male and female connector assemblies 100, 200. The sliding displacement feature of male floating carrier 150 within floating range d1 advantageously allows male and female connector assemblies 100, 200 to be assembled and connected without such fine adjustment of the length of adjustable extension barrels 340, 342 prior to assembly.

With reference again to FIG. 3A, in an exemplary embodiment intended for MWD service, heavy-duty spring 107 may advantageously be rated in the range from about 200 to about 1000 pounds per compressed inch (e.g., a nominal 600 pounds per compressed inch). In such an embodiment, heavy duty spring 107 may be pre-compressed, for example, about ¾ inch to exert about 400 lb of force when holding male floating carrier 150 in the rest position 118. Such a force on male floating carrier 150 in the rest position 118 tends to prevent rotation of the male floating carrier 150 about a cylindrical (longitudinal) axis. Further, when male and female connector assemblies 100, 200 are in the connected state, the pressure exerted by the heavy duty spring 107 on the male floating carrier 150 tends to keep male pin 104 tightly received within female connector assembly 200, thereby encouraging uninterrupted electrical communication between connector assemblies 100, 200. Moreover, when male pin 104 is tightly received within female connector assembly 200 and held in place by the pressure exerted by the heavy duty spring 107 on the male floating carrier 150, the connection between male and female connector assemblies 100, 200 becomes resistant to mechanical forces experienced downhole, such as vibration and impact shock.

Figures 4A, 4B:
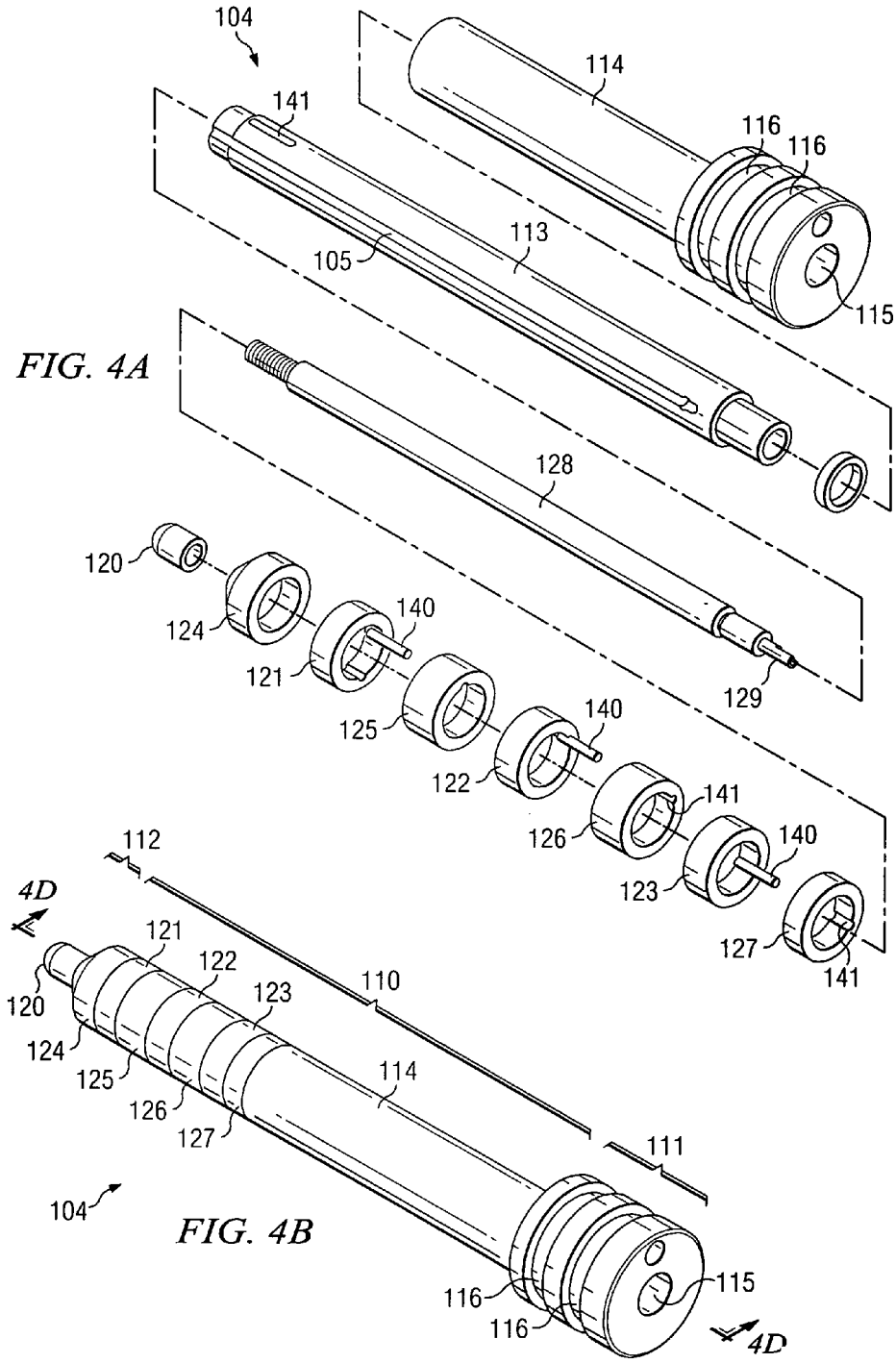
FIG. 4A is an exploded view of a male pin portion of the male connector assembly shown in FIG. 3A.
FIG. 4B is an assembled, perspective view of the male pin portion shown in FIG. 4A.
Figure 4C:
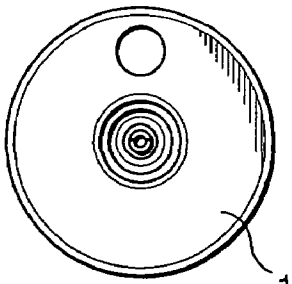
FIG. 4C is an end view of the embodiment shown on FIGS. 4A and 4B.
Figure 4D:
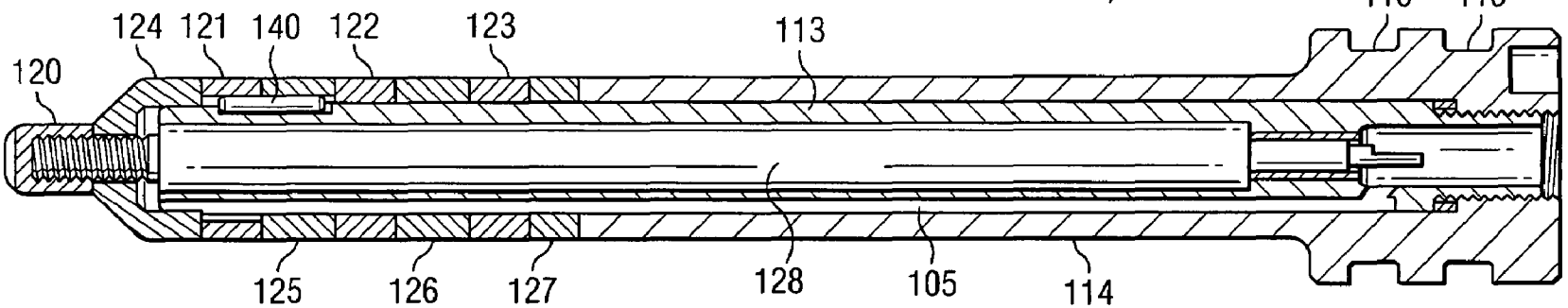
FIG. 4D is a cross sectional view as shown on FIG. 4B.

With continued reference to FIG. 3A and further reference to FIGS. 4A through 4D, exemplary embodiments of male pin assembly 104 are described in more detail. Male pin 104 includes a cylindrical base portion 111 coupled to shaft portion 110 that terminates in a nose portion 112 (FIG. 4B). In the disconnected state, as shown on FIG. 3A, nose portion 112 is located approximately coincident with (or slightly recessed within) the open end 108 of sleeve portion 106 in male connector assembly 100. Advantageously, nose portion 112 is shaped like the lower portion of a cone (e.g., frustroconical); the shape selected to mate with correspondingly shaped parts in shroud portion 204 of female connector assembly 200 (FIG. 5B). In one exemplary embodiment, shaft portion 110 is about 5 inches in length, having a diameter of about 0.65 inches. In such an embodiment, cylindrical base portion 111 has a diameter of about 1.0 inch. It will be understood that the invention is not limited to such dimensional design choices.

With continued reference to FIGS. 4A through 4D, center contact 120 protrudes at one end of male pin 104 and is electrically coupled (e.g., threaded) to a conductive rod 128. Rod 128 and center contact 120 may be fabricated from substantially any suitable electrically conductive material. In one embodiment intended for MWD service, in which there is the potential for high shock and impact levels, rod 128 and center contact 120 may be fabricated, for example, from a beryllium copper alloy, such as Alloy 25 (UNSC 17200). Beryllium copper alloys are typically highly electrically conductive and also may advantageously provide structural strength to male pin 104. Rod 128 is received within generally tubular insulator sleeve 113 fabricated from substantially any suitable insulator material. In one embodiment intended for MWD service, in which male pin 104 may be expected to experience elevated temperatures (e.g., up to 200 degrees C.), sleeve 113 may be fabricated from a Polyetheretherketone, such as PEEK™ (available from Victrex Corporation, Lancashire, UK). Sleeve 113 includes at least one longitudinal groove 105 for receiving wires 135, 136, 137 (not illustrated on FIGS. 4A–4D) that couple to a corresponding one of each of the contacts 121, 122, 123. The center contact 120 is connected directly to center rod 128, and is thereby suited, if desired, to carry high levels of current. At least one, and preferably a plurality of annular contacts 121, 122, 123 are received onto sleeve 113. Annular contact 121 is separated from center contact 120 by insulating spacer 124, received on the end of sleeve 113. Annular contacts 121, 122, 123 are separated from each other and lower housing 114 by annular insulating spacers 125, 126, 127, each of which is received onto sleeve 113. Referring particularly to FIG. 3A, contacts 121, 122, 123, may advantageously, although not necessarily, include dowels 140 that mate with grooves 141 formed in the outer cylindrical surface of the sleeve 113, and in the inner cylindrical surfaces of the annular contacts 121, 122, 123 and insulator spacers 125, 126, 127, so as to inhibit relative radial displacement of the entire assembly.

In one exemplary embodiment, each annular contact 121, 122, 123 includes an exposed longitudinal surface length of about ¼ inch and are longitudinally spaced at about 0.55 inch intervals. Such spacing has been found to provide an insulative barrier that deters electrical shorting between the individual contacts 121, 122, 123 in the event of fluid ingress into the contact area. It will be further appreciated that the contact arrangements for male pin 104 illustrated on FIGS. 3A, and 4A through 4D, are exemplary only. Alternative embodiments (not illustrated) of the male connector assembly may omit center contact 120, or may not use the center rod 128 as an electrical conduit.

With further reference to FIGS. 4A through 4D, male pin 104 further comprises lower housing 114 including a through bore 115 into which sleeve 113 and rod 128 are partially received. Lower housing 114 further includes a base portion 111 having relatively larger outer diameter than shaft portion 110. The base portion 111 includes at least one, and advantageously two or more, annular grooves 116 into which o-rings 143 may be received. O-rings 143 are intended to provide a fluid resistant seal between base portion 111 and floating carrier 150 (FIG. 3A). In exemplary embodiments intended for MWD service, lower housing 114 may be fabricated from a high strength corrosion resistant material such as an Inconel® nickel alloy (Huntington Alloys Corporation, Huntington, W.Va.).

As described above with respect to FIG. 3A, although not specifically illustrated, each of wires 134, 135, 136, 137 are electrically coupled to a corresponding one of contacts 120, 121, 122, 123. Each wire 134, 135, 136, 137, via corresponding contact 120, 121, 122, 123, may serve as an electrical conduit or transmission line for carrying electrical signals, data, power and/or ground. Housing 102 may also serve as ground. As also noted above with respect to FIG. 4A, longitudinal grooves 105 formed in the outer cylindrical surface of the insulator sleeve 113 are provided to facilitate routing of wires 135, 136, 37 through bore 115 of lower housing 114. Wire 134 may also be electrically coupled to the rear pin 129 of rod 128 in order to reach center contact 120. In exemplary embodiments intended for MWD service, wires 134, 135, 136, 137 may include high temperature insulation, and may further be epoxy-adhered to surfaces within male pin 104 after assembly so as to be rigid.

Although male connector assembly 100 is intended to be resistant to fluid ingress (such as through open end 108 of sleeve portion 106 on FIG. 3A), a high pressure connector 322, as shown on FIG. 3B, may optionally be used as an extra measure to deter fluid ingress into the interior portion 330 of adjustable extension barrel 340. As shown on FIG. 3B, such a high pressure connector 322 electrically couples wires 134, 135, 136, 137 to corresponding wires 361, 362, 363, 364 in interior portion 330 of adjustable extension barrel 340. In the exemplary embodiment shown on FIG. 3B, a locknut 335 retains the high pressure connector 322 to prevent fluid ingress into interior portion 330.

Female Connector Assembly

With reference now to FIGS. 5A through 6C, exemplary embodiments of female connector assembly 200 are described in more detail. Referring to FIG. 5B in particular, female assembly 200 includes a substantially tubular housing 202 having a shroud portion 204 sized and shaped for insertion into sleeve portion 106 of male housing 102 (FIG. 3A). In one embodiment of this invention about 4.25 inches of sleeve portion 106 overlaps with shroud portion 204 when the male and female assemblies 100, 200 are connected. Shroud portion 204 includes at least one (advantageously two or more) axial spaced groove 207 (e.g., about 0.25 inches wide) for receiving o-rings 208. Grooves 207 may further optionally include back-up rings 209 (e.g., fabricated from PEEK™). Ring seals 208, 209 are intended to provide a fluid resistant seal (preferably a high pressure fluid resistant seal) between sleeve 106 and shroud 204 when the male and female connector assemblies are connected.

Female connector assembly 200 further includes a female socket assembly 240 (see also FIGS. 6A through 6C) deployed substantially coaxially within housing 202. As described briefly above, and in more detail below with respect to FIGS. 6A through 6C, female socket assembly 240 includes a plurality of annular contact assemblies 241, 242, 243 configured for making electrical contact with corresponding annular contact members 121, 122, 123 in male contact assembly 100 (FIG. 3A).

With reference now to FIGS. 5A and 5B, female socket assembly 240 is deployed in a fluid filled chamber 210 within female housing 202. While not shown in isolation on FIGS. 5A and 5B, it will be understood that chamber 210 is the portion of the bore of female housing 202 bounded by upper bulkhead 220 shown on FIG. 5A and lower bulkhead 211 shown on FIG. 5B. Fluid filled chamber 210 may be filled with any suitable substantially non-conductive fluid, including liquid and gaseous fluids. In exemplary embodiments intended for MWD service, chamber 210 may be filled with a non-conductive oil such as UNIVIS® J26 available from Exxon Company, Houston, Tex. It will be understood that other suitable fluids are not restricted to oil, but rather the particular fluid may be selected based upon the particular application, such as operating temperature extremes and chemicals in the surrounding environment. Advantageous characteristics of a fluid suitable for the oil filled chamber 210 may include: high resistance to freezing, congealing, melting, and chemical breakdown; low compressibility; and low viscosity suitable to flow freely into open voids and crevices within chamber 210. Other advantageous characteristics of the fluid used to fill the oil filled chamber 210 may include low volatility, low evaporation rate, low solubility in water, high flash point, fairly low toxicity and a tendency not to react violently with water and other chemicals that potentially could seep into the chamber 210 from the external environment (e.g., various drilling and formation fluids).

Further, in downhole environments it is not uncommon to encounter downhole pressures as high as 25,000 psi. In exemplary embodiments intended for MWD service, it may therefore be advantageous to pressurize the fluid disposed in chamber 210 to provide a barrier against ingress of moisture and/or other impurities found in the external environment. It will be understood that such pressurization may require the use of various high pressure seals and fittings known to those of ordinary skill in the art.

With reference now to FIG. 5A, housing 202 includes a port 228 for filling chamber 210 with the above described oil or other fluid. A removable plug 229, having an o-ring seal 230, may be utilized to seal the port 228 as shown. During assembly of female connector assembly 200, chamber 210 may be filled, for example, by various vacuum filling techniques (e.g., evacuating the chamber 210 prior to filling). Vacuum techniques are typically desirable, as they tend to promote air displacement and thus the filling of various hard to reach regions (e.g., crevices) of the chamber 210. Once the chamber 210 has been filled (and optionally pressurized), the fluid therein tends to remain at a constant pressure when both connected and disconnected from the male connector assembly 100 (FIG. 2A).

With continued reference to FIG. 5A, fluid filled chamber 210, as noted above, is bounded on one end by upper bulkhead 220. A substantially fluid-resistant seal for deterring ingress of contaminant fluid and debris into fluid filled receptacle 210 (as well as for retaining the fluid in the chamber 210) may be provided by at least one o-ring 227 disposed in a corresponding annular groove on the outer cylindrical surface of the bulkhead 220. As described briefly above, upper bulkhead 220 further includes a plurality of mutually isolated terminals 221, 222, 223, 224 for electrically coupling electrical signals and/or power from outside the fluid filled chamber 210 to various components deployed therein. In the exemplary embodiment shown on FIG. 5A, each terminal 221, 222, 223, 224 electrically couples one of wires 236, 237, 238, 239 routed within the fluid filled chamber 210 to a corresponding one of wires 331, 332, 333, 334 deployed outside the chamber 210. As described above, such wires 331, 332, 333, 334 may be routed to, for example, instrumentation or power sources located elsewhere (not illustrated).

With reference now to FIG. 5B, fluid filled chamber 210, as noted above, is bound on the end opposing upper bulkhead 220 (FIG. 5A) by lower bulkhead 211. In the exemplary embodiment shown, lower bulkhead 211 is received into the bore of female housing 202, for example via threaded connection 215. A substantially fluid-resistant seal for deterring ingress of contaminant fluid and debris into fluid filled chamber 210 (as well as for retaining the fluid in the chamber 210) may be provided by at least one o-ring 226 disposed in a corresponding annular groove on the outer cylindrical surface of the lower bulkhead 211. In the exemplary embodiment shown, lower bulkhead 211 further includes a substantially cylindrical through bore 214 and a tapered counter bore 213 (also referred to herein as a receptacle entrance), which provide suitable access for male pin 104 (FIG. 3A) to couple with female socket assembly 240 upon connecting the male and female connector assemblies 100, 200 (FIGS. 2A and 2B).

With continued reference to FIG. 5B, the exemplary embodiment of female connector assembly 200 shown includes a retractable shaft assembly 250, a lower end 258 of which is received in through bore 214 of lower bulkhead 211. The lower end 258 of the shaft assembly includes a boss 251 that sealing engages the lower bulkhead 211 via o-rings 218, 219, which are deployed in annular grooves on the inner cylindrical surface of the bulkhead 211. Boss 251 includes downward facing surface 252, which is sized and shaped for a close-fitting mate with nose portion 112 of male connector assembly 100 (FIG. 3A). In exemplary embodiments intended for MWD service, boss 252 may be fabricated, for example, from a fiberglass composite.

Lower end 258 of retractable shaft assembly 250 includes a longitudinal female contact 254 suitable for receiving and electrically coupling with the center contact 120 protruding from the nose portion 112 of the male pin 104 (FIG. 3A). In exemplary embodiments intended for MWD service, retractable shaft assembly 250, as described above, is suitable for carrying electrical current and thus may be gold plated and fabricated from a beryllium copper alloy. In such embodiments, female contact 254 may include a bore formed in lower end 258 having a depth greater than the corresponding projecting male contact 120. The female contact 254 may further provide a contact insert 253 received into the bore, advantageously formed, for example, from gold plated copper. Contact insert 253 will be understood to be analogous in function to the flexible inserts 245 illustrated on FIGS. 6A and 6C (and described in more detail below), being generally cylindrical and formed to receive, encircle, and electrically couple the center male contact 120 to the retractable shaft assembly 250. Contact insert 253 may include, for example, a plurality of elongated tabs, extending generally in parallel around the cylindrical circumference. Each elongated tab is formed with a portion that bends radially inwards extending slightly into the space occupied by the male center contact 120 when in the disconnected state. Each tab further has a portion that bends radially outwards to engage and make electrical contact with the bore of retractable shaft assembly 250. The portion bent radially inwards is resilient and is disposed to yield radially to make electrical contact with a received center contact 120 of the male pin 104 in the connected state.

Retractable shaft assembly 250 extends upwards (away from female contact 254) and is received in and sealingly engaged with fluid-balancing piston 280 via one or more o-rings 283 disposed in corresponding grooves in through bore 286A of the fluid-balancing piston 280. A raised boss 259, extending radially outward from shaft assembly 250, abuts a lower face of fluid-balancing piston 280. Piston 280 is further sealingly engaged, substantially coaxially, with an internal surface of the housing 271 of an internal fluid-balancing chamber 270 via o-ring 282 disposed in a corresponding annular groove in the outer surface of the piston 280. In the embodiment shown, fluid-balancing piston 280 further includes an enlarged counter bore 286B having a spring member 277 deployed therein. Spring member 277 may be partially compressed between self locking nut 284 affixed to the end of the retractable shaft assembly 250 opposite contact 254 and fluid-balancing piston 280. Spring member 277 is intended to accommodate thermal expansion of the fluid in chamber 210 and thus promote uninterrupted electrical coupling between the fluid-balance piston 280 and retractable shaft assembly 250 by biasing fluid-balancing piston 280 onto raised boss 259.

One of ordinary skill in the art will readily recognize that the various features of the fluid-balancing piston 280 and the shaft assembly 250 may be provided by a single component (for example, a piston having an integral shaft assembly) rather than the dual components shown in FIG. 5B.

With reference now to FIGS. 5A and 5B, exemplary embodiments of female connector assembly 200 include an internal spring member 281 deployed between an upper bulkhead spacer 255 and fluid-balancing piston 280 in a fluid-balancing chamber 270. As described above, spring member 281 may function as an electrical conduit coupling the shaft assembly 250 to terminal 225, and in exemplary embodiments may be gold plated and fabricated from an electrically conductive material such as a beryllium copper alloy. When uncompressed, spring member 281 biases fluid-balancing piston 280 downwards towards female socket assembly 240 (into contact with insulator 232A in the embodiment shown). It will be appreciated that fluid-balancing piston 280 is configured to slide longitudinally within the fluid-balancing chamber 270 having a range of longitudinal motion d3 between a first position 288 and a second position 289 (shown on FIG. 5C). In the disconnected state (as shown in FIG. 5B), spring member 281 is typically disposed to bias fluid-balancing piston 280 in the first position. In such a position, the fluid-balancing piston 280 impinges on raised boss 259, which urges shaft assembly 250 downwards such that boss 251 sealingly engages bore 214 of lower bulkhead 211, thereby sealing the entrance to female contact assembly 200.

Fluid-balancing chamber 270 is provided by a fluid-balance housing 271, which, in exemplary embodiments intended for MWD service, is fabricated from an electrically insulating material fiber glass composite material. Fluid-balancing housing 271 is deployed substantially coaxially with housing 202 between upper bulkhead spacer 255 and female socket assembly 240. In various exemplary embodiments, the outer diameter of housing 271 is nearly equal to that of the inner diameter of housing 202 (e.g., the diameter of housing 271 may be about 0.005 inches less than the inner diameter of housing 202). Thus the outer surface of housing 271 may include one or more longitudinal grooves (not shown) for providing fluid communication between port 228 and female socket assembly 240 and for routing electrical wires to female socket assembly 240. As described in more detail below with respect to FIGS. 5C and 7B, the volume of chamber 270 decreases when male and female connector assemblies 100, 200 (FIGS. 2A and 2B) are connected to compensate for fluid displaced in chamber 210 by male pin 104 (FIG. 3A). It may be seen via a comparison of FIGS. 5B and 5C that the position of fluid-balancing piston 280 determines the volume of chamber 270. In exemplary embodiments intended for MWD service, fluid-balancing chamber 270 may be filled with a compressible fluid, such as air.

With reference again to FIG. 5A, upper bulkhead spacer 255 is disposed between upper bulkhead 220 and fluid-balancing housing 271. In the exemplary embodiment shown, spacer 255 includes a lower portion 256 having a reduced outer diameter that is sealing engaged with the inner cylindrical surface of the upper distal end of housing 271, e.g., via o-ring 273. A gap 264 may be provided between the upper portion 257 of the spacer 255 and housing 271 to allow for thermal expansion of the housing 271. A spring terminal 225 is sealingly engaged in a bore in the lower portion 256 of spacer 225 via o-ring 274 and may be deployed to electrically couple fluid-balancing spring member 281 with conductor 236 via pin 295. Channels 275 formed in spring terminal 225 provide a path for conductors 237, 238, 239 to be routed along longitudinal grooves 276 on the outer surface of housing 271 to contacts 241, 242, 243.

Figure 6B:
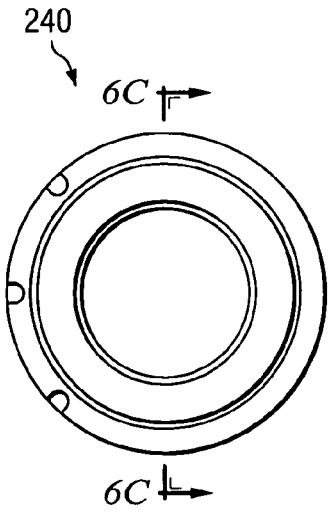
FIG. 6B is an end view of the embodiment of FIG. 6A.
Figure 6C:
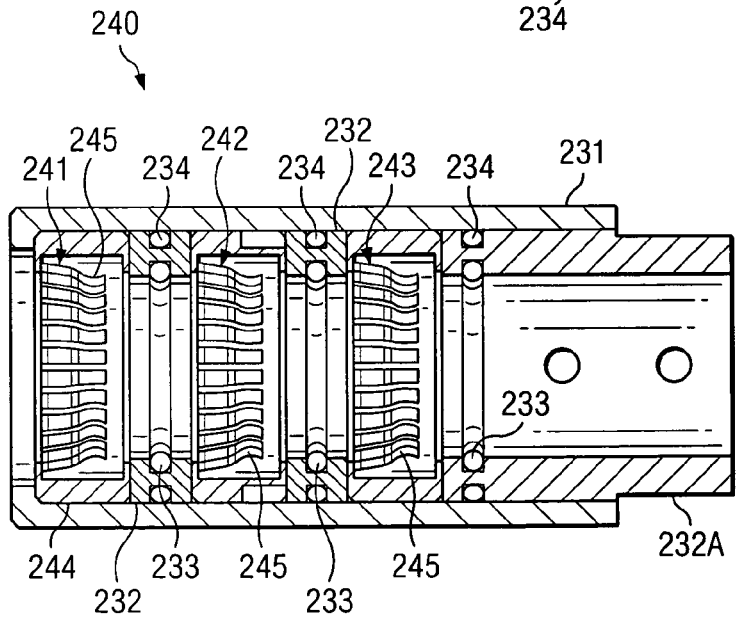
FIG. 6C is a cross sectional view as shown on FIG. 6B.

With reference now to FIGS. 6A through 6C, exemplary embodiments of female socket assembly 240 are described in more detail. Socket assembly 240 includes a plurality of ring contact assemblies 241, 242, 243 deployed in a socket housing 231. Each ring contact assembly 241, 242, 243 includes a contact holder 244, fabricated, for example, from a gold plated beryllium copper alloy. Contact holders 244 are ring shaped, having a through bore suitable for receiving the shaft portion 110 of male pin 104 (FIG. 3A), and include a counter bore 246 in an upper face 247. Each contact holder 244 further includes a longitudinal groove 291 on an outer surface thereof for electrically coupling with a wire (e.g., one of conductors 237, 238, 239). Indentations 292 are also formed in the outer surface of each of the contact holders 242 for receiving a dowel 293 through socket housing 231. Dowels 293 are intended to restrict movement of the contact holders 244 in the socket housing 231.

Each of the ring contact assemblies 241, 242, 243 further includes a ring-shaped, flexible insert 245 received within the counter bore 246 of a corresponding contact holder 244. In an embodiment intended for MWD service, flexible inserts 245 may be fabricated, for example, from gold-plated copper. As described above with respect to the center flexible contact insert 253 located within the contact 254 formed in the lower end 258 of shaft assembly 250, each flexible insert 245 includes a plurality of elongated tabs, extending generally in parallel around its cylindrical circumference. Each elongated tab may be formed with a portion that bends radially inwards extending slightly (for example, 0.03 inches on each radius) into the space occupied by the shaft portion 110 of male pin 104 (FIG. 3A) when in the disconnected state. Each tab further has a portion that bends radially outwards to engage and make electrical contact with its corresponding contact holder 244. The portion bent radially inwards is resilient and is disposed to yield radially to make electrical contact with a received annular contact portion 121, 122, 123 of the male pin 104 in the connected state. In the connected state, each flexible insert 245 is deflected by shaft portion 110 so as to exert positive pressure on the inner cylindrical surface of a contact holder 244 and on the exposed surface of one of the male annular contacts 121, 122, 123. Each flexible insert thus serves to electrically couple each ring contact assembly 241, 242, 243 to a corresponding one of the male annular contacts 121, 122, 123.

With continuing reference to FIGS. 6A through 6C, ring insulators 232 (fabricated, for example, from PEEK™) are received into socket housing 231 and are interposed between each ring contact assembly 241, 242, 243. In addition, an end insulator 232A is deployed above ring contact 243. Ring insulators 232 and end insulator 232A each include a through bore suitable for receiving the shaft portion 110 of the male pin 104 (FIG. 3A). Ring insulators 232 and end insulator 232A are further typically formed with an outer annular groove suitable to receive o-ring 234 for sealingly engaging the inner cylindrical surface of socket housing 231 and an inner annular groove suitable to receive o-ring 233 for sealingly engaging shaft portion 110 of the male pin 104, when in the connected state.

With continued reference to FIGS. 6A through 6C and further reference to FIGS. 5B and 7B, a plurality of fluid filled spaces 290 will be understood to be formed when the device is in the connected state. Fluid filled spaces 290 combine with annular insulating spacers 125, 126, 127 (FIGS. 4A through 4D) and ring insulators 232 (FIGS. 6A through 6C) to electrically isolate each corresponding pair of electrically coupled female ring contact assemblies 241, 242, 243 and male annular contacts 121, 122, 123. The fluid filled spaces 290 are substantially filled with a suitable fluid, such as oil in an exemplary embodiment described above, and are effectively compartmentalized to discourage the flow of such fluids between adjacent fluid filled spaces 290. In addition, in the connected state, the two electrically coupled center contacts 254, 120 are electrically isolated from the adjacent electrically coupled female ring contact assemblies 241, 242, 243 and male annular contacts 121, 122, 123.

Connecting and Disconnecting

With reference now to FIGS. 7A and 7B, and occasional reference to FIGS. 3A through 3C and 5A through 5C, the connecting and disconnecting of exemplary embodiments of this invention will now be described in more detail. As the complementary threaded portions 308, 310 of the drill collar segments screw together, face 205 of the female shroud portion 204 contacts male wiper piston 160. The male wiper piston 160 responds by moving from the first position 165 (FIG. 3A) to the second position 166 (FIGS. 3C and 7B), thereby substantially compressing spring member 177. The shroud portion 204 of the female connector assembly 200 is shown on FIG. 7B to be engaged and sealed with the sleeve portion 106 of the male connector assembly 100. The interlocking sleeve portion 106 and shroud portion 204 provide several advantages. These include forming a barrier to fluid ingress into the contact area, providing substantial strength to the joint, and creating a pressurized seal. In an embodiment intended for MWD service, the seal may be able to withstand up to 25,000 psi (e.g., by using sealing rings 208, 209). Further, as the upper and lower drill collar segments 300, 302 thread together, the female shroud portion 204 may rotate about a cylindrical tool axis in relationship to the sleeve portion 106 while maintaining the pressurized seal. In addition, as face 205 of the female shroud portion 204 presses on the male wiper piston 160 and is received into the sleeve portion 106, the female connector assembly 200 may rotate about a cylindrical tool axis in relationship with the male connector assembly 100.

As the complementary threaded portions 308, 310 of the drill collar segments thread together, the nose portion 112 of the male pin 104 (FIG. 3A) engages the front facing surface 252 of the lower portion 258 of shaft assembly 250 (FIG. 5B). The center contact 120 of the male pin 104 is received and electrically coupled to female contact 254. The male pin 104 exerts pressure on shaft assembly 250, which retracts in unison with the oil balance piston 280 from its first position 288 (FIG. 5B) to its second position 289 (FIGS. 5C and 7A), thereby substantially compressing fluid-balancing spring member 281.

As shaft assembly 250 retracts and the male pin 104 enters the entrance 213 to the fluid filled chamber 210, the shaft portion 110 of the male pin 104 sealingly engages o-rings 218, 219 disposed in the bore of the front bulkhead 211.

O-rings 218 and 219 combine to provide a fluid-resistant seal for the fluid filled chamber 210 as the device transforms from a disconnected to a connected state, as at first the boss 251, and then the male pin 104, displace within the bore 214 of front bulkhead 211. O-rings 218, 219 also advantageously wipe fluid and debris from the exposed surfaces of contacts 121, 122, 123 of the male pin 104 as it is received into the central cavity of the female socket assembly 240. It will be understood that wiping of fluid and debris may enhance the quality of the electrical contact between male contacts 121, 122, 123 and corresponding female contact assemblies 241, 242, 243. The cylindrical surface of the shaft portion 110 sealingly engages the annular o-rings 233 and presses against the flexible portions 245 of the ring contact assemblies 241–243 (FIGS. 6A and 6C), which respond by exerting positive pressure on the shaft portion 110 of the male pin 104. The male pin 104 continues to be received into the female socket assembly 240 until fluid-balancing spring 281 is substantially compressed and each of the annular contacts 121, 122, 123 deployed on the male pin are aligned with a corresponding one of the plurality of ring contacts assemblies 241, 242, 243 deployed in the female socket assembly 240. While in such a configuration male contacts 121, 122, 123 are fully engaged with female contacts 241, 242, 243, it will be appreciated (and described in more detail below) that in a preferred embodiment intended for MWD service, full tool engagement is not achieved until threads 308 and 310 are fully engaged (fully tightened together). The male pin 104 may rotate about a cylindrical tool axis in relationship to the female connector assembly 200 and female socket assembly 240 while the male pin 104 is being inserted into the receptacle entrance 213 and received into the female socket assembly 240. Upon removal of the male pin 104 from female socket assembly 240, fluid-balancing spring 281 urges fluid-balancing piston 280 and shaft assembly 250 downward to sealingly engage lower bulkhead 211.

It will be appreciated by comparing FIGS. 5B and 7B that penetration of the male pin 104 into the socket assembly 240 displaces fluid from the fluid filled chamber 210. In the exemplary embodiments shown, the upward movement of shaft assembly 250 and fluid-balancing piston 280 into fluid-balancing chamber 210 compensates for such fluid displacement. The upward movement of the fluid-balancing piston 280 reduces the volume of the fluid-balancing chamber 270, thereby increasing the volume of the fluid filled chamber 210 (as shown at 210' in FIG. 5C) by substantially the same volume as that displaced by the male pin 104. As such, the pressure of the fluid in the fluid filled chamber 210 remains essentially unchanged during connecting and disconnecting of male and female connector assemblies 100, 200. In order to accommodate the upward movement of piston 280 during connecting of the male and female connector assemblies 100, 200, the fluid-balancing chamber 270 is advantageously evacuated or filled with a compressible fluid, such as air.

With further reference to FIGS. 7A and 7B, as the male wiper piston 160 retracts in response to the force applied by the female shroud portion 204, it engages the male floating carrier 150, on which the male pin 104 is deployed. The female shroud portion 204 mechanically couples through the male wiper piston 160 to the male floating carrier 150. After springs member 177 and fluid-balancing spring 281 have been substantially fully compressed, the male pin 104 is fully engaged with the female contact assembly 240, and thus the electrical connections between the various data and/or power transmission lines are established. Continued engagement of complementary threaded portions 308, 310 urges male floating carrier 150 towards its second position 119 (FIG. 3C) thereby compressing heavy-duty spring member 107. FIGS. 3C and 7B show male floating carrier in the second position 119 (with spring member 107 substantially fully compressed), however, in the connected state, it will be understood that male floating carrier 150 may be positioned anywhere between the first and second positions 118, 119 (i.e., anywhere within the d1 range). As described above, such positioning of the male floating carrier 150 advantageously enables the male pin 104 to remain correctly aligned longitudinally with the female socket assembly 240, independent of small variations in the calculated or set lengths of adjustable extension barrels 340, 342 (FIGS. 2A and 2B).

Numerous o-ring sealing members are referred to in the exemplary embodiments of this invention described above. It will be appreciated that substantially any suitable sealing arrangements may be utilized in various exemplary embodiments of this invention and that the invention is not limited to any particular sealing arrangements. In certain exemplary embodiments intended for MWD service, o-rings (and/or other sealing members) fabricated from various fluoroelastomer materials, such as VITON® and FLUOROC® (available, for example, from DuPont® de Nemours, Wilmington, Del.) may be advantageous.

The invention has been described above with reference to three separate annular contacts and a center contact, providing four separate connected electrical pathways. It will nonetheless be appreciated that the invention is not limited in this regard, and that any number of separate annular contacts may be deployed, with or without a center contact. Additionally, throughout this disclosure various exemplary embodiments having particular dimensions are disclosed. It will be understood this invention is in no way limited to such dimensional design choices.

Although the present invention and its advantages have been described in detail, it should be understood that various changes, substitutions and alternations can be made herein without departing from the spirit and scope of the invention as defined by the appended claims.

I claim:

1. A male connector assembly for a matched male and female electrical connector pair, the male connector assembly comprising:

a housing having a longitudinal axis and an opening on one end;

a male pin assembly deployed in the housing, the male pin assembly including a plurality of male contact members sized and shaped for selectively making and breaking electrical contact with a corresponding plurality of female contact members on a corresponding female connector assembly;

the male pin assembly coupled to a floating carrier, the floating carrier configured to displace along the longitudinal axis between a first floating carrier position and a second floating carrier position, the first floating carrier position located nearer to opening than the second floating carrier position;

a substantially annular wiper piston deployed about the male pin assembly and interposed between the floating carrier and the opening, the wiper piston configured to displace along the longitudinal axis between a first wiper piston position and a second wiper piston position, the first wiper piston position located nearer to the opening than the second wiper piston position; and the wiper piston disposed to sealingly isolate at least one of the plurality of male contact members from the opening when the wiper piston is in the first wiper piston position.

2. The male connector assembly of claim 1, further comprising a first substantially cylindrical drill collar having a threaded end portion, the male connector assembly deployed substantially coaxially within the first drill collar so that the opening in the housing is proximate to the threaded end portion of the first drill collar.

3. The male connector assembly of claim 2, further comprising a second substantially cylindrical drill collar also having a threaded end portion, wherein the first drill collar is configured to threadably couple with the second drill collar via their corresponding threaded end portions, the female connector assembly deployed substantially coaxially within the second drill collar such that coupling the first and second drill collars via their threaded end portions enables electrical communication between the plurality of male contact members and the corresponding plurality of female contact members.

4. The male connector assembly of claim 1, wherein one of the plurality of contact members on the male pin assembly is located centrally on one end of the male pin assembly and proximate to the opening in the housing.

5. The male connector assembly of claim 4, wherein:

the plurality of contact members further comprises at least two annularly shaped contact members that are longitudinally spaced along the male pin assembly;

said central contact member being electrically coupled to a conductive rod deployed in a core portion of the male pin assembly, the conductive rod being further deployed in a substantially insulating sleeve; and said at least two annularly shaped contact members being deployed substantially coaxially about the insulating sleeve, each annularly shaped contact member separated from neighboring annularly shaped contact members by a spacer including an annular insulating spacer.

6. The male connector assembly of claim 1, wherein at least two of the plurality of contact members are annularly shaped and longitudinally spaced along the male pin assembly, each annular contact member separated from its neighboring annular contact members by a spacer including an annular insulating spacer.

7. The male connector assembly of claim 1, further comprising a spring member deployed between the wiper piston and the floating carrier, the spring member biasing the wiper piston towards the first wiper piston position.

8. The male connector assembly of claim 7, wherein the spring member is substantially uncompressed when the wiper piston is in the first wiper piston position and substantially fully compressed when the wiper piston is in the second wiper piston position.

9. The male connector assembly of claim 1, further comprising a sealing member deployed on an inner annular surface of the wiper piston, the sealing member disposed to wipe an outer surface of at least one of the plurality of contact members deployed on the male pin assembly when the wiper piston displaces between first and second wiper piston positions.

10. The male connector assembly of claim 1, wherein:

the wiper piston is located substantially in the first wiper piston position when the male connector assembly is disconnected from the corresponding female connector assembly; and the wiper piston is displaced substantially to the second wiper piston position when the male connector assembly is fully connected with the corresponding female connector assembly.

11. The male connector assembly of claim 1, further comprising a spring member deployed between the floating carrier and a buttress member rigidly affixed within the housing, the buttress member located further distal from the opening than the floating carrier.

12. The male connector assembly of claim 11, wherein:

the spring member is partially compressed when the floating carrier is in the first floating carrier position; and the spring member is substantially fully compressed when the floating carrier is in the second floating carrier position.

13. The male connector assembly of claim 1, wherein:

the floating carrier is biased in the first floating carrier position when the male connector assembly is disconnected from the corresponding female connector assembly; and the floating carrier is displaced from the first floating carrier position towards the second floating carrier position when the male connector assembly is fully connected with the corresponding female connector assembly.

14. The male connector assembly of claim 13, wherein each of the plurality of male contact members remain in electrical communication with the corresponding ones of the plurality of female contact members while the floating carrier reciprocates between first and second floating carrier positions.

15. A female connector assembly for a matched male and female electrical connector pair, the female connector assembly comprising:

a housing having a longitudinal axis and an opening on one end thereof, the housing providing an internal chamber between first and second bulkheads, the internal chamber disposed to be filled with a fluid;

a female socket assembly having a plurality of female contact members, the female socket assembly deployed in the internal chamber of the housing, the plurality of female contact members sized and shaped for selectively making and breaking electrical contact with a corresponding plurality of male contact members on a corresponding male connector assembly;

an internal housing deployed in the internal chamber of the female housing, the internal housing providing a fluid-balancing chamber between a fluid balancing piston and the first bulkhead;

the fluid-balancing piston configured to displace along the longitudinal axis between first and second fluid-balancing piston positions in the fluid-balancing chamber; and the fluid-balancing chamber having a first volume when the fluid-balancing piston is in its first position and a second volume when the fluid-balancing piston is in its second position, the difference between the first and second volumes being substantially equal to a volume of the fluid displaced in the internal chamber by a male pin on the corresponding male connector assembly when male and female connector assemblies are connected.

16. The female connector assembly of claim 15, further comprising a first substantially cylindrical drill collar having a threaded end portion, the female connector assembly deployed substantially coaxially within the first drill collar so that the opening in the housing is proximate to the threaded end portion of the drill collar.

17. The female connector assembly of claim 16, further comprising a second substantially cylindrical drill collar also having a threaded end portion, wherein the first drill collar is configured to threadably couple with the second drill collar via their corresponding threaded end portions, the male connector assembly deployed substantially coaxially within the second drill collar such that coupling the first and second drill collars via their threaded end portions enables electrical communication between the plurality of female contact members and the corresponding plurality of male contact members.

18. The female connector assembly of claim 15, wherein:

the socket assembly includes a bore; and the female connector assembly further comprises a shaft assembly receivable in the bore of the socket assembly, the shaft assembly configured to displace along the longitudinal axis with the fluid-balancing piston between the first and second positions, at least a portion of the shaft assembly deployed between the fluid-balancing piston and the opening, the shaft assembly disposed to sealingly isolate at least one of the plurality of female contact members from the opening when the shaft assembly is in the first position.

19. The female connector assembly of claim 18, further comprising a sealing member deployed on an outer surface of the shaft assembly, the sealing member disposed to wipe an inner surface of at least one of the plurality of female contact members deployed on the female socket assembly when the shaft assembly displaces between first and second positions.

20. The female connector assembly of claim 18, wherein the end of the shaft assembly located proximate to the opening includes a recessed electrical contact, the recessed electrical contact being suitable for receiving and electrically coupling with a corresponding protruding electrical contact on the male connector assembly.

21. The female connector assembly of claim 20, wherein:

the shaft assembly comprises an electrically conductive material; and the fluid-balancing chamber includes a spring member deployed therein, the spring member disposed to bias the fluid-balancing piston and the shaft assembly towards the first position, the spring member also comprising an electrically conductive material and electrically coupled through the shaft assembly to the recessed electrical contact.

22. The female connector assembly of claim 15, wherein at least two of the plurality of female contact members are ring shaped and longitudinally spaced, each ring shaped female contact member separated from its neighboring ring shaped contact members by a spacer including a ring shaped insulator.

23. The female connector assembly of claim 22, wherein each of said at least two ring female contact members further includes a ring shaped, flexible, and electrically conductive insert deployed in an electrically conductive contact holder, each insert including a plurality of elongated tabs, each tab having first and second portions, the first portion being resilient and extending radially inwards towards a center of the ring shaped insert so as to be disposed to engage and make electrical contact with a corresponding annular contact member of the corresponding male connector assembly, the second portion extending radially outwards away from the center of the ring shaped insert so as to be disposed to engage and make electrical contact with the corresponding contact holder.

24. The female connector assembly of claim 15, further comprising a spring member deployed in the fluid-balancing chamber, the spring member disposed to bias the fluid-balancing piston towards the first position.

25. The female connector assembly of claim 24, wherein:

the spring member is substantially uncompressed when the shaft assembly and fluid-balancing piston are in the first position; and the spring member is compressed when the shaft assembly and the fluid-balancing piston are in the second position.

26. The female connector assembly of claim 15, wherein the internal chamber is disposed to be filled with a substantially non-conductive oil.

27. The female connector assembly of claim 15, wherein the fluid-balancing chamber is disposed to be filled with a compressible fluid.

28. The female connector assembly of claim 15, wherein fluid in the internal chamber is disposed to be held at pressure, and wherein said pressure remains substantially constant during connecting and disconnecting of the female connector assembly with the corresponding male connector assembly.

29. An electrical connector for selectively connecting and disconnecting a plurality of electrical lines, the electrical connector comprising:

a male housing having a longitudinal axis and two ends, the male housing including a first opening on one end thereof;

a male pin assembly deployed in the male housing, the male pin assembly including a plurality of male contact members;

a substantially annular wiper piston deployed about the male pin assembly in the male housing, the wiper piston configured to displace along the longitudinal axis of the male housing between a first wiper piston position and a second wiper piston position, the first wiper piston position located nearer to the first opening than the second wiper piston position, the wiper piston disposed to sealingly isolate at least one of the plurality of male contact members from the first opening when the wiper piston is in the first wiper piston position;

a female housing having a longitudinal axis and two ends, the female housing including a second opening on one end thereof;

a female socket assembly deployed in the female housing, the female socket assembly including a plurality of female contact members and having a bore configured for receiving a portion of the male pin assembly;

a shaft assembly receivable in the bore of the female socket assembly, the shaft assembly configured to displace along the longitudinal axis of the female housing between a first shaft assembly position and a second shaft assembly position, the first shaft assembly position located nearer to the second opening than the second shaft assembly position, the shaft assembly disposed to sealingly isolate at least one of the plurality of female contact members from the second opening when the shaft assembly is in the first shaft assembly position;

the male pin assembly configured to engage and disengage with the female socket assembly such that each of the plurality male contact members electrically couple and decouple with corresponding ones of the plurality of female contact members upon connecting and disconnecting of the electrical connector.

30. The electrical connector of claim 29, further comprising first and second substantially cylindrical drill collars each having a threaded end portion, and wherein:

the male housing is deployed in the first drill collar with the first opening proximate to the threaded end portion of the first drill collar;

the female housing is deployed in the second drill collar with the second opening proximate to the threaded end portion of the second drill collar; and connection of the first and second drill collars via respective threaded end portions enables electrical communication between the plurality of male contact members and the plurality of female contact members.

31. The electrical connector of claim 29, further comprising:

a first sealing member deployed on an inner surface of the wiper piston, the first sealing member disposed to wipe an outer surface of at least one of the plurality of male contact members deployed on the male pin assembly when the wiper piston displaces between first and second wiper piston positions; and a second sealing member deployed on an outer surface of the shaft assembly, the second sealing member disposed to wipe an inner surface of at least one of the plurality of female contact members deployed on the female socket assembly when the shaft assembly displaces between first and second shaft assembly positions.

32. The electrical connector of claim 29, wherein:

the wiper piston is located substantially in the first wiper piston position and the shaft assembly is located substantially in the first shaft assembly position when the electrical connector is disconnected; and the wiper piston is displaced substantially to the second wiper piston position and the shaft assembly is displaced substantially to the second shaft assembly position when the electrical connector is connected.

33. The electrical connector of claim 29, further comprising:

a protruding contact located centrally on an end of the male pin assembly proximate to the first opening;

a recessed electrical contact located on an end of the shaft assembly proximate to the second opening; and the recessed electrical contact and the protruding contact configured for electrically coupling with one another when the electrical connector is connected.

34. The electrical connector of claim 29, wherein:

the plurality of male contact members further includes at least two annularly shaped contact members that are longitudinally spaced along the male pin assembly;

the plurality of female contact members further includes at least two ring shaped contact members that are longitudinally spaced in the female socket assembly; and said at least two annularly shaped contact members and said at least two ring shaped contact members are configured for electrical coupling one with another when the electrical connector is connected.

35. The electrical connector of claim 29, wherein:

the male pin assembly is coupled to a floating carrier, the floating carrier configured to displace along the longitudinal axis of the male housing between a first floating carrier position and a second floating carrier position;

the floating carrier is located substantially in the first position when the electrical connector is disconnected and displaced between the first position and the second position when the electrical connector is connected; and each of the plurality of male contact members remain in electrical communication with corresponding ones of the plurality of female contact members while the floating carrier reciprocates between the first and second floating carrier positions.

36. An electrical connector for selectively connecting and disconnecting a plurality of electrical lines, the electrical connector comprising:

a male housing having a longitudinal axis and two ends with a first opening on one end thereof;

a male pin assembly deployed in the male housing, the male pin assembly including a plurality of male contact members;

a female housing having a longitudinal axis and two ends with a second opening on one end thereof, the female housing providing an internal chamber between first and second bulkheads, the internal chamber disposed to be filled with a fluid;

a female socket assembly having a plurality of female contact members, the female socket assembly deployed in the internal chamber;

an internal housing deployed in the internal chamber of the female housing, the internal housing providing a fluid-balancing chamber between a fluid balancing piston and the first bulkhead;

the male pin assembly configured to engage and disengage with the female socket assembly such that each of the plurality male contact members electrically couple and decouple with corresponding ones of the plurality of female contact members upon connecting and disconnecting of the electrical connector;

the fluid-balancing piston configured to displace along the longitudinal axis of the female housing between first and second positions in the fluid-balancing chamber; and the fluid-balancing chamber having a first volume when the fluid-balancing piston is in the first position and a second volume when the fluid-balancing piston is in the second position, the difference between the first and second volumes being substantially equal to a volume of the fluid displaced in the internal chamber by the male pin assembly when the electrical connector is connected.

37. The electrical connector of claim 36, further comprising first and second substantially cylindrical drill collars each having a threaded end portion, and wherein:

the male housing is deployed in the first drill collar with the first opening proximate to the threaded end portion of the first drill collar;

the female housing is deployed in the second drill collar with the second opening proximate to the threaded end portion of the second drill collar; and connection of the first and second drill collars via respective threaded end portions enables electrical communication between the plurality of male contact members and the plurality of female contact members.

38. The electrical connector of claim 36, further comprising a spring member deployed in the fluid-balancing chamber, the spring member disposed to bias the fluid-balancing piston towards the first position, wherein the spring member is substantially uncompressed when the shaft assembly and fluid-balancing piston are in the first position and the spring member is compressed when the shaft assembly and the fluid-balancing piston are in the second position.

39. The electrical connector of claim 36, wherein:

the internal chamber is disposed to be filled with a substantially non-conductive oil; and the fluid-balancing chamber is disposed to be filled with a compressible fluid.

40. The electrical connector of claim 36, wherein:

the fluid in the internal chamber is disposed to be held at pressure; and said pressure remains substantially constant during connecting and disconnecting of the electrical connector.

41. The electrical connector of claim 36, wherein:

the plurality of male contact members further includes at least two annularly shaped contact members that are longitudinally spaced along the male pin assembly;

the plurality of female contact members further includes at least two ring shaped contact members that are longitudinally spaced in the female socket assembly; and said at least two annularly shaped contact members and said at least two ring shaped contact members are configured for electrical coupling one with another when the electrical connector is connected.

42. The electrical connector of claim 36, wherein the male pin assembly is coupled to a floating carrier, the floating carrier configured to displace along the longitudinal axis of the male housing between a first floating carrier position and a second floating carrier position;

the floating carrier is located substantially in the first position when the electrical connector is disconnected and displaced between the first position and the second position when the electrical connector is connected; and each of the plurality of male contact members remain in electrical communication with corresponding ones of the plurality of female contact members while the floating carrier reciprocates between the first and second floating carrier positions.

43. The electrical connector of claim 36, further comprising:

a substantially annular wiper piston deployed about the male pin assembly in the male housing, the wiper piston configured to displace along the longitudinal axis of the male housing between a first wiper piston position and a second wiper piston position, the first wiper piston position located nearer to the first opening than the second wiper piston position, the wiper piston disposed to sealingly isolate at least one of the plurality of male contact members from the first opening when the wiper piston is in the first wiper piston position; and a shaft assembly receivable in a bore in the female socket assembly, the shaft assembly configured to displace along the longitudinal axis of the female housing between a first shaft assembly position and a second shaft assembly position, the first shaft assembly position located nearer to the second opening than the second shaft assembly position, the shaft assembly disposed to sealingly isolate at least one of the plurality of female contact members from the second opening when the shaft assembly is in the first shaft assembly position.

44. The electrical connector of claim 43, wherein the male pin assembly and the shaft assembly each have two ends, the electrical connector further comprising:

a protruding contact located centrally on an end of the male pin assembly deployed proximate to the first opening; and a recessed electrical contact located on an end of the shaft assembly deployed proximate to the second opening, the recessed electrical contact and the protruding contact configured for electrical coupling one with another when the electrical connector is connected.

45. The electrical connector of claim 43, wherein:

the male pin assembly is coupled to a floating carrier, the floating carrier configured to displace along the longitudinal axis of the male housing between a first floating carrier position and a second floating carrier position;

the floating carrier is located substantially in the first position when the electrical connector is disconnected, the floating carrier displaced between the first and second floating carrier positions when the electrical connector is connected; and each of the plurality of male contact members remain in electrical communication with corresponding ones of the plurality of female contact members while the floating carrier reciprocates between the first and second floating carrier positions.

46. An electrical connector for selectively connecting and disconnecting a plurality of electrical lines, the electrical connector comprising:

a male housing having a longitudinal axis and two ends with a first opening on one end thereof;

a male pin assembly deployed in the male housing, the male pin assembly including a plurality of male contact members;

the male pin assembly coupled to a floating carrier, the floating carrier configured to displace along the longitudinal axis of the male housing between a first floating carrier position and a second floating carrier position;

a female housing having a longitudinal axis and two ends with a second opening one end thereof;

a female socket assembly deployed in the female housing, the female socket assembly including a plurality of female contact members;

the male pin assembly configured to engage and disengage with the female socket assembly such that each of the plurality of male contact members electrically couple and decouple with corresponding ones of the plurality of female contact members upon connecting and disconnecting of the electrical connector;

wherein the floating carrier is located substantially in the first position when the electrical connector is disconnected, the floating carrier displaced between first and second floating carrier positions when the electrical connector is connected; and wherein each of the plurality of male contact members remain in electrical communication with the corresponding ones of the plurality of female contact members while the floating carrier reciprocates between the first and second floating carrier positions.

47. The electrical connector of claim 46, further comprising first and second substantially cylindrical drill collars each having a threaded end portion, and wherein:

the male housing is deployed in the first drill collar with the first opening proximate to the threaded end portion of the first drill collar;

the female housing is deployed in the second drill collar with the second opening proximate to the threaded end portion of the second drill collar; and connection of the first and second drill collars via respective threaded end portions enables electrical communication between the plurality of male contact members and the plurality of female contact members.

48. The electrical connector of claim 46, further comprising a spring member deployed between the floating carrier and a buttress member rigidly affixed within the housing, the buttress member located further distal from the first opening than the floating carrier, wherein the spring member is partially compressed when the floating carrier is in the first floating carrier position and the spring member is substantially fully compressed when the floating carrier is in the second floating carrier position.

49. The electrical connector of claim 46, wherein:

the floating carrier is biased in the first floating carrier position when the electrical connector is disconnected; and the floating carrier is displaced between the first floating carrier position and the second floating carrier position when the electrical connector is fully connected.

50. The electrical connector of claim 46, wherein:

the plurality of male contact members further includes at least two annularly shaped contact members that are longitudinally spaced along the male pin assembly;

the plurality of female contact members further includes at least two ring shaped contact members that are longitudinally spaced in the female socket assembly; and said at least two annularly shaped contact members and said at least two ring shaped contact members are configured for electrical coupling one with another when the electrical connector is connected.

51. A downhole tool including first and second modules deployed in corresponding first and second drill collars, the first and second drill collars each having at least a first threaded end, the downhole tool including an electrical connector for selectively electrically coupling and decoupling the first and second modules, the electrical connector comprising:

a two-ended male housing deployed in the first module, the male housing having a first opening on one end thereof located proximate to the first threaded end of the first drill collar;

a male pin assembly deployed in the male housing, the male pin assembly including a plurality of male contact members;

a two-ended female housing deployed in the second module, the female housing having a longitudinal axis and a second opening on one end thereof located proximate to the first threaded end of the second drill collar, the female housing providing an internal chamber between first and second bulkheads, the internal chamber disposed to be filled with a fluid;

a female socket assembly having a plurality of female contact members, the female socket assembly deployed in the internal chamber;

an internal housing deployed in the internal chamber of the female housing, the internal housing providing a fluid-balancing chamber between a fluid balancing piston and the first bulkhead;

the male pin assembly configured to engage and disengage with the female socket assembly such that each of the plurality male contact members electrically couple and decouple with corresponding ones of the plurality of female contact members upon connecting and disconnecting of the electrical connector;

the fluid-balancing piston configured to displace along the longitudinal axis of the female housing between first and second fluid-balancing piston positions in the fluid-balancing chamber; and the fluid-balancing chamber having a first volume when the fluid-balancing piston is in its first position and a second volume when the fluid-balancing piston is in its second position, the difference between the first and second volumes being substantially equal to a volume of the fluid displaced in the internal chamber by the male pin assembly when the electrical connector is connected.

52. A modular measurement while drilling tool comprising:

a plurality of measurement while drilling modules;

each of the plurality of measurement while drilling modules deployed within a corresponding drill collar, the drill collars each having first and second opposing threaded end portions for selectively coupling and decoupling one with another;

first selected ones of the measurement while drilling modules including a male electrical connector assembly, each male electrical connector assembly deployed proximate to the first threaded end of its corresponding drill collar, second selected ones of the measurement while drilling modules including a female electrical connector assembly, each female electrical connector assembly deployed proximate to the second threaded end of its corresponding drill collar;

each male electrical connector assembly including:

a two-ended male housing having a first opening on one end thereof located proximate to the first threaded end; and a male pin assembly deployed in the male housing, the male pin assembly including a plurality of male contact members; and each female electrical connector assembly including:

a two-ended female housing having a longitudinal axis and a second opening on one end thereof located proximate to the second threaded end, the female housing providing an internal chamber between first and second bulkheads, the internal chamber disposed to be filled with a fluid;

a female socket assembly having a plurality of female contact members, the female socket assembly deployed in the internal chamber;

an internal housing deployed in the internal chamber of the female housing, the internal housing providing a fluid-balancing chamber between a fluid balancing piston and the first bulkhead;

the fluid-balancing piston configured to displace along the longitudinal axis of the female housing between first and second fluid-balancing piston positions in the fluid-balancing chamber;

the fluid-balancing chamber having a first volume when the fluid-balancing piston is in its first position and a second volume when the fluid-balancing piston is in its second position, the difference between the first and second volumes being substantially equal to a volume of the fluid displaced in the internal chamber by the male pin assembly when the electrical connector is connected;

wherein each male pin assembly is configured to engage and disengage with an opposing female socket assembly such that each of the plurality male contact members electrically couple and decouple with corresponding ones of the plurality of female contact members when the first and second opposing threaded end portions of surrounding drill collars are threaded together.

53. The modular measurement while drilling tool of claim 52, wherein at least one of the plurality of measurement while drilling modules is selected from the group consisting of sensor modules, communications modules, formation fluid sampling modules, and power modules.

* * * * *